US007883089B2

(12) United States Patent
Sudo et al.

(10) Patent No.: US 7,883,089 B2
(45) Date of Patent: Feb. 8, 2011

(54) IMAGE FORMING APPARATUS

(75) Inventors: Kazuhisa Sudo, Kanagawa (JP); Mikio Ishibashi, Kanagawa (JP); Megumi Ohtoshi, Kanagawa (JP); Reki Nakamura, Kanagawa (JP); Masafumi Yamada, Kanagawa (JP); Toshihiro Sugiyama, Tokyo (JP); Yukiko Iwasaki, Kanagawa (JP); Nobuyuki Koinuma, Kanagawa (JP); Takashi Sakamaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 651 days.

(21) Appl. No.: 11/806,863

(22) Filed: Jun. 5, 2007

(65) Prior Publication Data

US 2007/0278735 A1 Dec. 6, 2007

(30) Foreign Application Priority Data

Jun. 5, 2006 (JP) ..... 2006-156713
Mar. 6, 2007 (JP) ..... 2007-056451

(51) Int. Cl.
*B65H 5/04* (2006.01)

(52) U.S. Cl. ..... 271/273; 271/176; 271/272; 271/274

(58) Field of Classification Search ..... 271/272–274, 271/314, 176, 265.01, 258.01
See application file for complete search history.

(56) References Cited

U.S. PATENT DOCUMENTS 3,372,925 A * 3/1968 De Vries et al. ..... 271/37
4,195,832 A * 4/1980 Krumrey ..... 271/274
4,871,162 A * 10/1989 Imai et al. ..... 271/35
5,067,835 A * 11/1991 Yamamoto et al. ..... 400/582
5,870,114 A * 2/1999 Numata et al. ..... 347/16
5,934,665 A * 8/1999 Kasahara ..... 271/122
6,390,464 B1 * 5/2002 Gutierrez et al. ..... 271/184
6,508,465 B1 * 1/2003 Endo ..... 271/265.01
6,663,238 B2 * 12/2003 Kikuchi et al. ..... 347/102
7,458,573 B2 * 12/2008 Park ..... 271/122

FOREIGN PATENT DOCUMENTS

JP 6-87558 A 3/1994
JP 7-304214 A 11/1995
JP 10-133515 A 5/1998
JP 10-177285 A 6/1998

(Continued)

OTHER PUBLICATIONS

Office Action dated Mar. 27, 2009 issued in corresponding Chinese Application No. 2007101085609 and English translation thereof.

*Primary Examiner*—Stefanos Karmis
*Assistant Examiner*—Thomas A Morrison
(74) *Attorney, Agent, or Firm*—Harness, Dickey & Pierce, PLC

(57) ABSTRACT

In an image forming apparatus including an image forming unit that forms an image on a recording medium conveyed from a sheet feeding unit to obtain an image with photographic quality, at least a part of the recording medium has a transparent portion. When an image obtained by reversing an original image is transferred onto the transparent part, sheet-delivery rollers are operable in a direction in which a pressure onto the recording medium is reduced immediately after fixing of the image.

7 Claims, 19 Drawing Sheets

FOREIGN PATENT DOCUMENTS

| | | | |
|---|---|---|---|
| JP | 2001-305894 | A | 11/2001 |
| JP | 2002-072630 | | 3/2002 |
| JP | 2002-341623 | A | 11/2002 |
| JP | 2003-270991 | A | 9/2003 |
| JP | 2003-337494 | * | 11/2003 |
| JP | 2004-191678 | A | 7/2004 |
| JP | 2004-352425 | * | 12/2004 |
| JP | 2006-301323 | A | 11/2006 |

* cited by examiner

20
ORIGINAL IMAGE (DATA OR DOCUMENT)

20a
20
Cℓ
FOLD
20b
AFTER IMAGE FORMATION ACCORDING TO EMBODIMENT 20
20a
20b
ROTATE 20
20b
20a

20
WRITABLE PORTION THROUGH HAND DRAWING OR THE LIKE
WHITE SUPERPOSITION

SURFACE LAYOUT OF SHEET SUBJECTED TO NORMAL CENTER FOLDING OPERATION

SURFACE LAYOUT ON SHEET FOR PHOTOGRAPHIC PRINT (ASSUME THAT IMAGE SURFACE IS ON TRANSPARENT MEDIUM SIDE)

DELIVERED WITH UNREVERSED IMAGE SURFACE BEING FOLDED INSIDE OF CENTER FOLDING

| | (1) | (2) | (3) | (4) |
|---|---|---|---|---|
| |  |  |  |  |
| DRIVE A SIDE CAUSE B SIDE TO FOLLOW | CONVEYANCE IMPOSSIBLE | POOR CONVEYANCE | CONVEYANCE IMPOSSIBLE | POOR CONVEYANCE |
| CAUSE A SIDE TO FOLLOW DRIVE B SIDE | POOR CONVEYANCE | GOOD CONVEYANCE | POOR CONVEYANCE | GOOD CONVEYANCE |

IMAGE FORMING APPARATUS

CROSS-REFERENCE TO RELATED APPLICATIONS

The present document incorporates by reference the entire contents of Japanese priority documents, 2006-156713 filed in Japan on Jun. 5, 2006 and 2007-056451 filed in Japan on Mar. 6, 2007.

BACKGROUND OF THE INVENTION

1. Field of the Invention

The present invention relates to an improvement of an image forming apparatus including an image forming unit that forms an image with photographic quality on a recording medium conveyed from a sheet feeding unit.

2. Description of the Related Art

Conventionally, to obtain a desired glossy image with photographic quality by using an electrophotographic image forming apparatus, a special toner, a special recording medium, a special fixing device, and others have been tried to be used (refer to Japanese Patent Application Laid-Open No. 2002-341623 (hereinafter, "a first patent document"), Japanese Patent Application Laid-Open No. 2004-191678 (hereinafter, "a second patent document"), and Japanese Patent Application Laid-Open No. 2003-270991 (hereinafter, "a third patent document").

For example, in the first patent document, a special toner is used for providing a gloss. After normal image formation on a sheet, a transparent toner is uniformly formed and fixed over the entire recording medium before being conveyed to a fixing unit, thereby obtaining photographic quality.

Also, in a technology typified by the second patent document, a special recording medium for providing a gloss is used. A thermoplastic resin layer is provided on a front or back of a recording medium. By further applying heat and pressure after an image is normally fixed, a uniform gloss can be achieved on the surface.

Furthermore, in the third embodiment, a special fixing device is used to provide a gloss. After a normal fixing process (first fixing), a second fixing unit formed of a smooth belt is provided to cool and is provided for cooling and peeling after a toner is again melted. With the use of the smoothness of the belt, a uniform gloss can be obtained.

However, the technology disclosed in the first patent document has problems in which a uniform transparent toner has to be always provided over the entire surface of the recording medium and a difference in toner thickness between an image part and a non-image part increases a load on the fixing unit. Moreover, to use the technology disclosed in the second patent document, its effect cannot be achieved until a special fixing device as explained in the third patent document. This poses problems in configuration, cost, power consumption, and others.

SUMMARY OF THE INVENTION

It is an object of the present invention to at least partially solve the problems in the conventional technology.

An image forming apparatus according to one aspect of the present invention includes a sheet feeding unit that feeds a recording medium including a transparent portion; an image forming unit that forms an image on the transparent portion of the recording medium; a sheet-delivery unit that delivers the recording medium conveyed from the image forming unit, the sheet-delivery unit including two sheet-deliver members forming a pair; and a control unit that controls each of function units constituting the image forming apparatus. Outer circumferential ends of the two sheet-delivery members are disposed with an axial position being shifted from each other. At least one of the sheet-delivery members is configured to be freely movable back and forth with respect to other of the sheet-delivery members. When an image obtained by reversing an original image is transferred onto the transparent portion of the recording medium, the control unit causes the sheet-delivery members to be operated in a direction in which a pressure to the recording medium is reduced.

An image forming apparatus according to another aspect of the present invention includes a sheet feeding unit that feeds a recording medium including a transparent portion; an image forming unit that forms an image on the transparent portion of the recording medium; a sheet-delivery unit that delivers the recording medium conveyed from the image forming unit, the sheet-delivery unit including two sheet-deliver members forming a pair; and a control unit that controls each of function units constituting the image forming apparatus. Outer circumferential ends of the two sheet-delivery members are disposed with an axial position being shifted from each other. At least one of the sheet-delivery members is configured to be freely movable back and forth with respect to other of the sheet-delivery members. The control unit causes the sheet-delivery members to be operated in a direction in which a space between the sheet-delivery members is widened immediately after delivery of the recording medium from the image forming unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
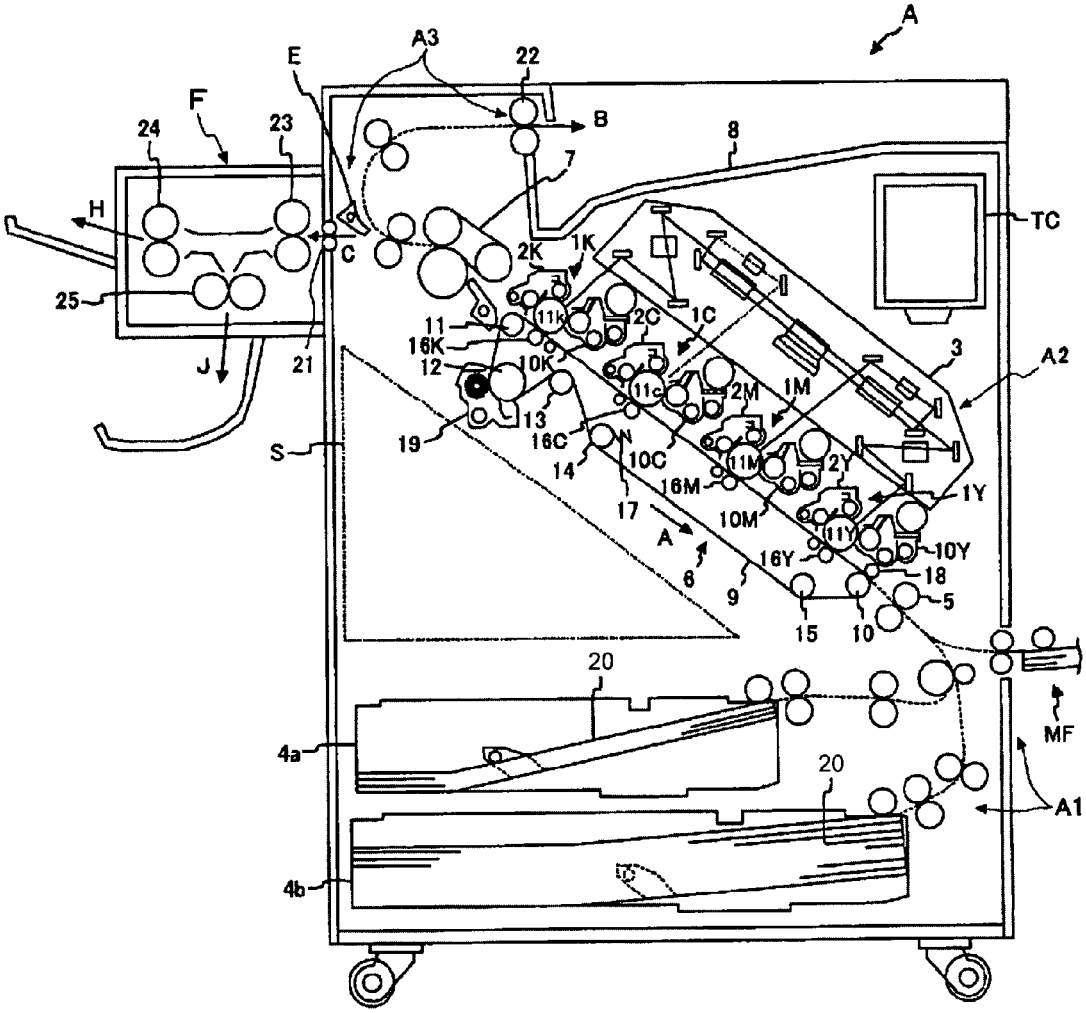
FIG. 1 is a schematic drawing of the configuration of an electrophotographic image forming apparatus to which the present invention is applied.

With reference to the drawings, embodiments according to the present invention are explained in detail below. FIG. 1 is a schematic view of the configuration of a general electrophotographic image forming apparatus.

An image forming apparatus A has an image forming apparatus body having a sheet feeding unit A1, an image forming unit A2, a sheet delivering unit A3, and a control unit (Central Processing Unit (CPU)), and a post-processing device (center folding device) F that performs a post-process on a sheet delivered from the sheet delivering unit A3.

The sheet feeding unit A1 includes sheet-feeding cassettes 4*a* and 4*b* on which transfer sheets 20 are placed. Also, a manual sheet-feeding tray MF is provided for manual sheet feeding from a side of the image forming apparatus.

The image forming unit A2 includes four image forming units 1Y, 1M, 1C, and 1K for forming images of yellow (Y), magenta (M), cyan (C), and black (K), respectively, a transferring unit 6, a fixing unit 7, and others. The order of colors of Y, M, C, and K is not meant to be restricted to an arrangement example shown in FIG. 1, but another order can be used.

The image forming units 1Y, 1M, 1C, and 1K each include a relevant one of photosensitive drums 11Y, 11M, 11C, and 11K as an image carrier, a charging unit, a developing unit, and a cleaning unit. Also, the image forming units 1Y, 1M, 1C, and 1K are set to be arranged with predetermined pitches in a transfer-sheet moving direction so that the rotational axes of the photosensitive drums 11Y, 11M, 11C, and 11K are parallel to one another.

Above the image forming units 1Y, 1M, 1C, and 1K is an optical writing unit 3 including a light source, a polygon mirror, an f-θ lens, and a reflection mirror. In the optical writing unit 3, the surfaces of the photosensitive drums 11Y, 11M, 11C, and 11K are scanned and radiated with laser light based on image data. Below the image forming units 1Y, 1M, 1C, and 1K is the transferring unit 6 as a belt driving device having a transfer conveyor belt 9 that carries and conveys a transfer sheet so that the transfer sheet can pass through a transferring unit of each image forming unit.

On an outer circumferential surface of the transfer conveyor belt 9, a cleaning device 19 including a brush roller and a cleaning blade is disposed to be making contact with the transfer conveyor belt 9. With the cleaning device 19, foreign matters such as toner attached onto the transfer conveyor belt 9 are removed.

On a side of the transferring unit 6 are the fixing unit 7 of a belt fixing scheme, a sheet-delivery tray 8, paired sheet-delivery rollers (paired sheet-delivery members) 21 and 22, and others. Below the image forming unit A2 is the sheet feeding unit A1.

In addition, a toner resupply container TC is provided, and also a waste toner bottle, a both-side/reversing unit, a power supplying unit, and others that are not shown are provided in a space S indicated by a one-dot-chain line.

Developing devices 10Y, 10M, 10C, and 10K as developing units have a similar configuration, are of a two-component development type, and are different only in toner color for use. The developing devices 10Y, 10M, 10C, and 10K each have accommodated therein a developer formed of a toner and a magnetic carrier.

The developing devices 10Y, 10M, 10C, and 10K each include a developing roller facing the photosensitive drum 11, a screw that conveys and agitates the developer, a toner density sensor, and others. The developing roller is formed of a freely-rotatable sleeve on an outer side and a magnet fixed to an inner side. According to an output from the toner density sensor, the toner is resupplied from the toner resupply container TC.

The paired sheet-delivery rollers (paired sheet-delivery members) 21 forming the sheet delivering unit A3 are units that deliver a recording medium conveyed from the image forming unit A2 with its face up (with an image surface upward) to the outside of the machine. The sheet-delivery tray 8 is a unit that receives the recording medium delivered from the paired sheet-delivery rollers (paired sheet-delivery members) 22 with its face down (with an image surface downward).

In the present invention, the paired sheet-delivery rollers 21 and 22 are formed such that one roller is freely movable back and forth (closer and away) with respect to another roller, thereby making it possible to adjust a pressure onto the recording medium to be delivered.

Each component explained above operates based on a control signal from the control unit not shown.

An image formation flow is explained. First, a predetermined voltage is applied from a power supply not shown to a charging roller to charge the photosensitive drum 11 (Y, M, C, and K) that faces the charging roller. The surface of the photosensitive drum 11 (Y, M, C, and K) charged at a predetermined potential is then scanned with laser light by the optical writing unit 3 based on image data. With this, an electrostatic latent image is written.

When the surface of the photosensitive drums 11 (Y, M, C, and K) carrying the electrostatic latent image reaches the developing device 10 (Y, M, C, and K), toner is supplied to the electrostatic latent image on the surface of the photosensitive drums 11 (Y, M, C, and K) from the developing roller disposed so as to face the photosensitive drum 11 (Y, M, C, and K), thereby forming a toner image.

The operation explained above is performed similarly on all photosensitive units 2Y, 2M, 2C, and 2K at each predetermined timing. On each of the surfaces of the photosensitive drums 11Y, 11M, 11C, and 11K, a toner image of a predetermined color is formed.

The transfer sheet 20 is conveyed from any one of sheet-feeding cassettes 4*a* and 4*b* and the manual sheet-feeding tray MF, and temporarily stops when reaching resist rollers 5. Then, the transfer sheet 20 is sent from the resist rollers 5 in timing with the image forming operation of the photosensitive units 2Y, 2M, 2C, and 2K, and conveyed by the transfer conveyor belt 9, thereby sequentially transferring the toner images on the photosensitive drums 11 (Y, M, C, and K).

The toner images are transferred onto the transfer sheet from initial transfer rollers 16Y, 16M, 16C, and 16K disposed so as to face the photosensitive drums 11Y, 11M, 11C, and 11K across the transfer conveyor belt 9 by applying a voltage with a polarity opposite to the polarity of the toner on the photosensitive drums 11 (Y, M, C, and K) is supplied from the power supply not shown.

The transfer sheet 20 passing through a position-facing the photosensitive drum 11K to have the toner images of four colors superposed thereon is then conveyed to the fixing unit 7, where the image is fixed by receiving heat and pressure.

The image forming units for use in the present embodiment are not particularly characterized by the configuration explained above. Alternatively, for example, a light-emitting diode can be used in place of a laser for writing. Still alternatively, one-component developing units can be used in place of the two-component developing units. Still alternatively, a roller or an induction-heating scheme can be used as a fixing unit in place of the belt. Still alternatively, an inkjet printing unit can be used as an image forming unit.

Also, the image forming unit A2 according to the present invention has a configuration that allows image formation on not only a normal paper sheet but also a transparent resin sheet, such as an overhead projector (OHP) sheet. Furthermore, the image forming unit A2 has a function of forming an image with photographic quality on a recording medium.

For a recording medium, such as an OHP sheet, depriving a large amount of heat at the time of fixing, an amount of temperature decrease of a heating roller at the time of fixing by the fixing unit 7 is large. Therefore, a conveying speed has to be decreased. For this reason, when image formation is performed on an OHP sheet, the conveying speed is decreased approximately by half of the conveying speed for normal paper sheets in the image forming apparatus. Therefore, the OHP sheet delivered after heat fixing is soft due to residual heat, and a roller mark tends to be attached to the OHP sheet by the pressure from a sheet-delivery roller (roller for providing strength) provided at the sheet delivering unit.

FIGS. 2A to 2D are schematic drawings of recording media for use in the image forming apparatus according to the present invention.

In FIGS. 2A to 2D, an arrow indicates a direction of conveying a recording medium. For example, as in FIG. 2A, a recording medium 20 is configured of a non-transparent portion 20*a* occupying over half of the recording medium in the recording-medium conveying direction, and a transparent portion 20*b* occupying the rest.

Figure 2A:
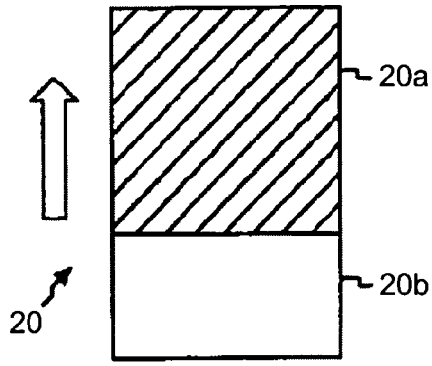
FIGS. 2A to 2D are schematic drawings of recording media for use in the image forming apparatus according to the present invention.
Figure 2B:
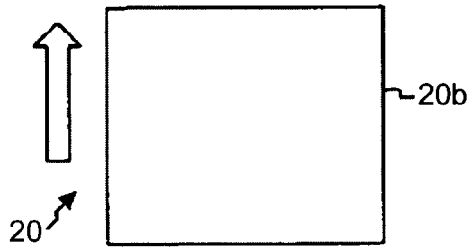
Figure 2C:
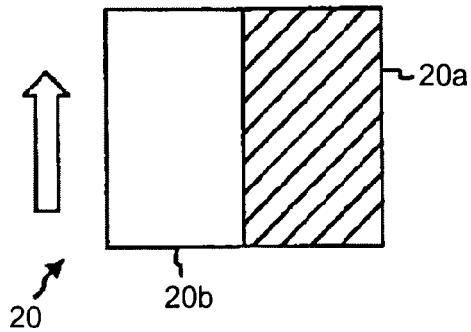
Figure 2D:
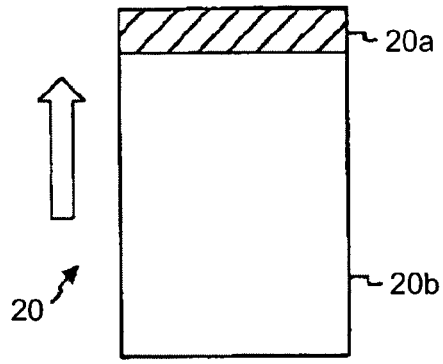

Alternatively, as in FIG. 2B, all of the recording medium 20 may be configured of the transparent portion 20*b*. Still alternatively, as in FIG. 2C, a half of the recording medium 20 in the recording-medium conveying direction may be configured of the non-transparent portion 20*a* and the remaining half thereof may be configured of the transparent portion 20*b*. As a matter of course, as in FIG. 2D, a small portion of the recording medium 20 in the recording-medium conveying direction may be configured of the non-transparent portion 20*a* and the remaining most may be configured of the transparent portion 20*b*.

Here, the non-transparent portion 20*a* includes those in white color or other non-transparent portions, and the transparent portion 20*b* does not mean a portion in a completely transparent state, but broadly includes portions in a translucent state and other quasi-transparent states.

Also, the transparent portion 20*b* may be configured of an OHP sheet, whilst the non-transparent portion 20*a* is configured of a normal paper sheet or the like. Alternatively, the entire portion may be configured of an OHP sheet, whilst a non-transparent sheet may be attached to a portion corresponding to the non-transparent portion 20*a*.

Examples of a scheme of setting in the image forming apparatus a condition in which the recording medium 20 at least a part of which is the transparent portion 20*b* is allowed to pass through include a scheme in which a user specifies in advance with settings from an operating unit or the sheet-feeding unit and a scheme in which a transparent area of a specific size is registered in advance in the image forming apparatus.

After a transparent area is defined, when determining that an image is formed on at least the transparent portion 20*b*, the control unit causes an image to be formed automatically as being reversed. As a result, on one side of the recording medium 20 after passing through the fixing unit 7 (FIG. 1), the reversed image will be formed on at least the transparent portion 20*b*.

The recording medium 20 subjected to the image formation with the scheme explained above is superposed with its image formation surface downward on a white medium, thereby easily obtaining a photographic image. With the image formation surface facing down and being on the white medium, excellent preservability can be achieved without directly damaging the image formation surface from outside.

FIGS. 3A to 3E are schematic perspective views for explaining details of a process of the center folding device shown in FIG. 1. An image is transferred onto the transparent portion 20*b* of the recording medium 20, and then this image is fixed. At this time, a mirror-reversed image (FIG. 5) is printed on the transparent portion 20*b*.

After passing through the fixing unit 7, the recording medium 20 is conveyed from the image forming apparatus A to the post-processing device (in this case, the center folding device F). That is, a branching nail E is disposed at an appropriate position after fixing, and by switching the branching nail E, whether the recording medium is delivered via the sheet-delivery rollers 22 to the sheet-delivery tray 8 or is delivered via the sheet-delivery rollers 21 to the center folding device F (in a C direction) is switched.

In a normal center folding device F, for the purpose of sequentially superposing sheets of a plurality of pages, they are reversed before entering the center folding device F. In the present embodiment, a branching device not shown is provided at this portion, thereby allowing the sheets to be sent to the center folding device F without reversal. That is, only with the provision of the branching device, a folding reverse to the folding of the normal center folding device can be achieved.

The center folding device F is generally used to stack outputs of a plurality of sheets and staple and fold them at a center portion. For photographic images with excellent preservability according to the present embodiment, a folding operation is performed every time a single photographic image is obtained. Therefore, no reversing operation is required.

Figure 3A:
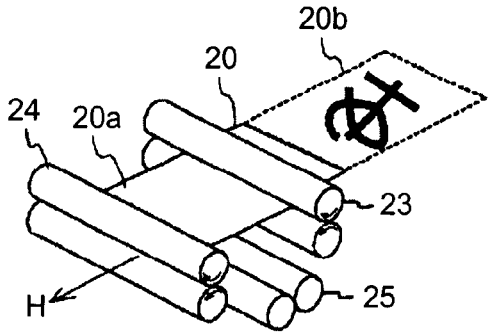
FIGS. 3A to 3E are schematic perspective views for explaining details of a process of a center folding device shown in FIG. 1.
Figure 3B:
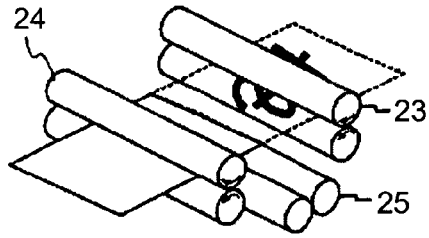

As shown in FIG. 1 and FIGS. 3A to 3E, the center folding device F is configured of paired rollers 23, 24, and 25. The recording medium 20 depicted any one of in FIGS. 2A to 2D after passing through the fixing unit 7 from the image forming apparatus A to the center folding device F then passes through the paired rollers 23 to the paired roller 24 (FIGS. 3A and 3B).

Figure 3C:
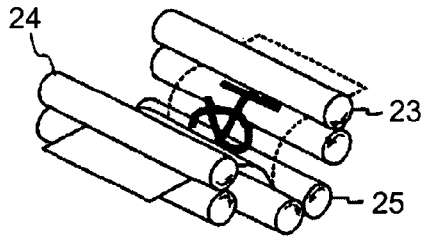
Figure 3D:
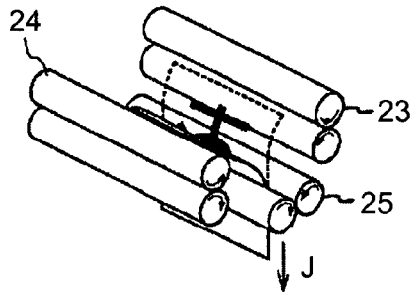
Figure 3E:
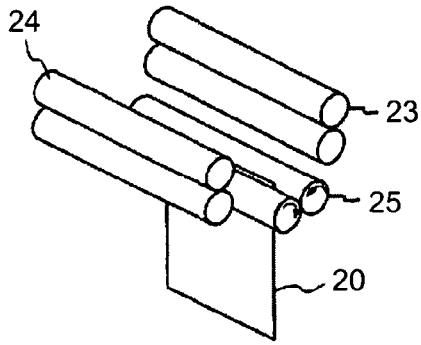

In this case, the tip of the recording medium 20 passing through the paired rollers 23 and conveyed to the paired roller 24 is once conveyed in an H direction in FIG. 1. Then, when the boundary between the non-transparent portion 20*a* and the transparent portion 20*b* reaches approximately above the paired rollers 25 as shown in FIG. 3B, the paired rollers 24 are rotated in a reverse direction to sag the recording medium 20 toward the paired rollers 25 (FIG. 3C). Then, the recording medium 20 is get caught in a nip of the paired rollers 25 to cause the non-transparent portion 20*a* and the transparent portion 20*b* to be superposed each other, and is then delivered in a J direction (FIGS. 3D and 3E).

Figure 5:
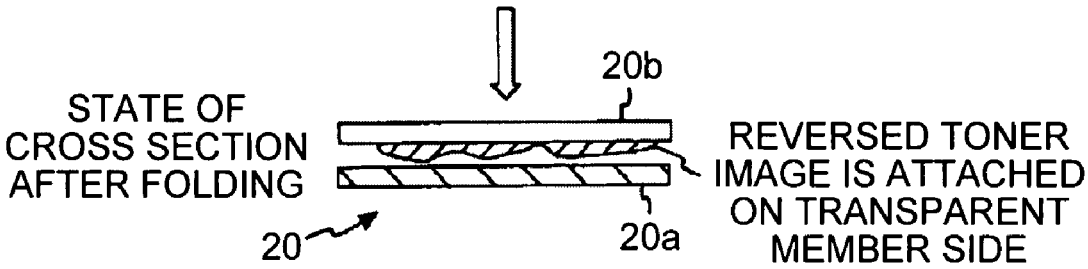
FIG. 5 is a schematic cross-section view of a configuration of a cross-section portion of an image generated according to the present embodiment through folding or white superposition.
Figure 6:
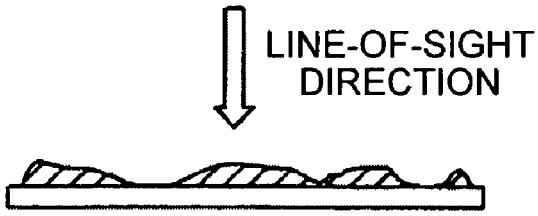
FIG. 6 is a schematic cross-section view of a normal print image for comparison with a print image according to the present invention.

FIGS. 4A to 4D and FIGS. 4A and 4E are schematic drawings of flows of forming a photographic image (image mirroring printing) by the image forming apparatus and the center folding device according to the present embodiment. FIG. 5 is a schematic cross-section view of a configuration of a cross-section portion of an image generated according to the present embodiment through folding or white superposition. FIG. 6 is a schematic cross-section view of a normal print image for comparison with a print image according to the present invention.

Figures 4A, 4B, 4C, 4D, 4E:
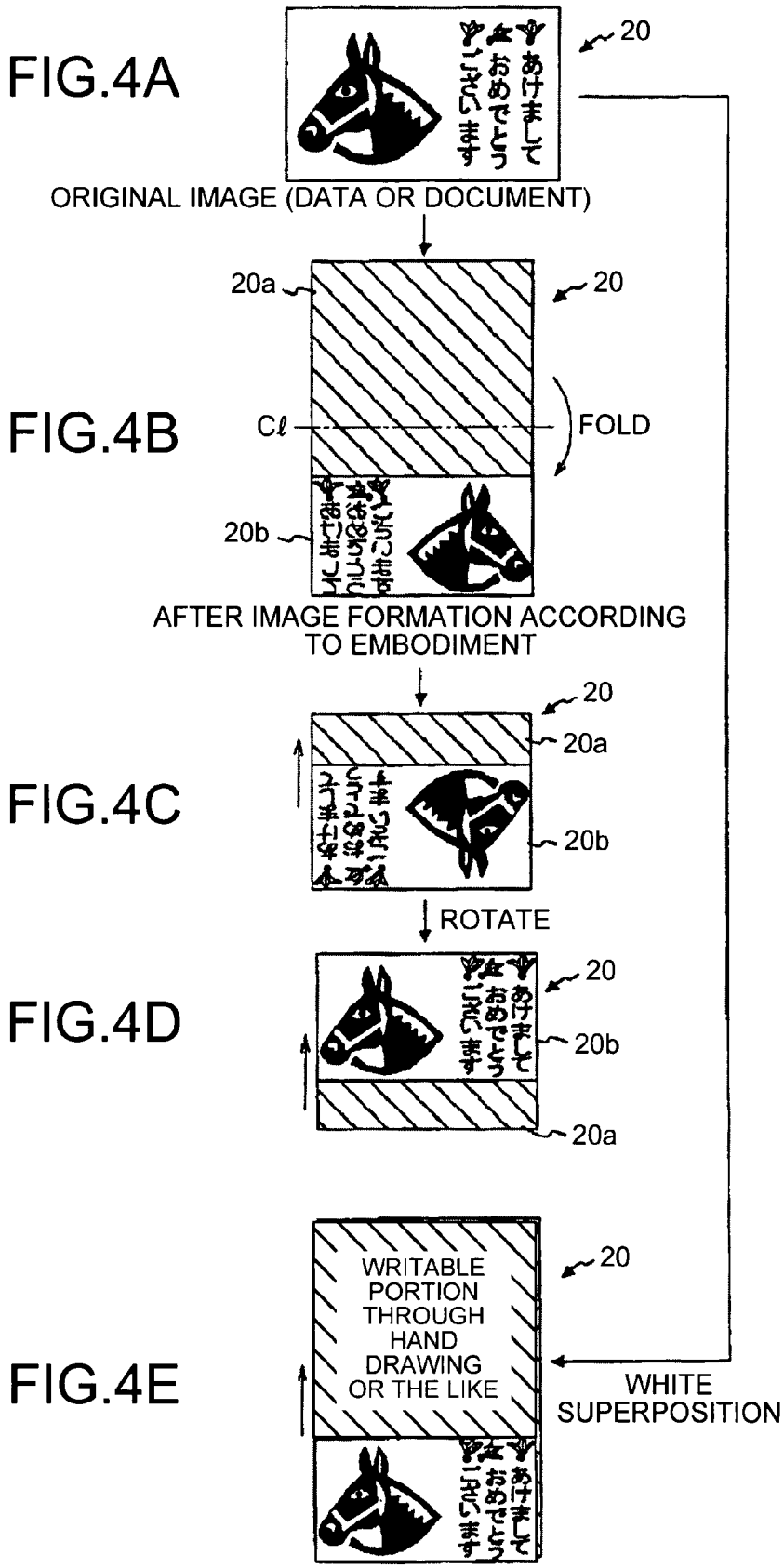
FIGS. 4A to 4E are schematic drawings of flows of a photographic image generated according to the present embodiment.

First, in the image forming procedure in FIGS. 4A to 4D, an original image in FIG. 4A is formed on the transparent portion 20*b* of the recording medium 20 as shown in FIG. 4B. Next, as shown in FIG. 4C, the non-transparent portion 20*a* is folded at its center portion cl by half, the recording medium is turned upside down, and further as shown in FIG. 4D, the recording medium is rotated inside out to place a transferred image in a direction as in the direction of the original image. Next, as shown in FIG. 4E, a white medium, that is, another non-transparent recording medium, is superposed and fixed onto the image transfer surface of the transparent portion 20*b* retaining the transferred image. With this, a print with a photographic image having a large non-transparent area that can be written later can be formed.

The image output in this manner is in a form where a toner layer T is present between the transparent portion 20*b* and the non-transparent portion 20*a* of the recording medium 20 as shown in FIG. 5. That is, FIG. 5 depicts the configuration of a cross-section portion of the image obtained through folding or white superposition, where a reversed image is formed on the transparent portion 20*b* of the recording medium 20. That is, an image component (reversed toner) is closely attached to a transparent base (the transparent portion 20*b*) side. Since the image is mirrored for printing through the FIGS. 4A, 4B, 4C, and 4D on the precondition that the image is to be folded, the toner image surface is viewed from the back through the transparent portion 20*b* as shown in FIG. 5.

For comparison with FIG. 5, in the case of a normal print image in FIG. 6, a toner surface with asperities is directly viewed, and therefore the image does not have smoothness. However, when the toner image is viewed through the transparent portion 20*b* as generated in the image forming apparatus according to the present invention, a toner surface without asperities is present in a line-of-sight direction. Therefore, the toner image seems to be smooth. Furthermore, reflected light from the surface of the transparent portion 20*b* is caught by eyes. Therefore, because of the flatness of the toner image and the reflected light from the transparent portion 20*b*, the image seems to be a photographic image.

Figure 7A:
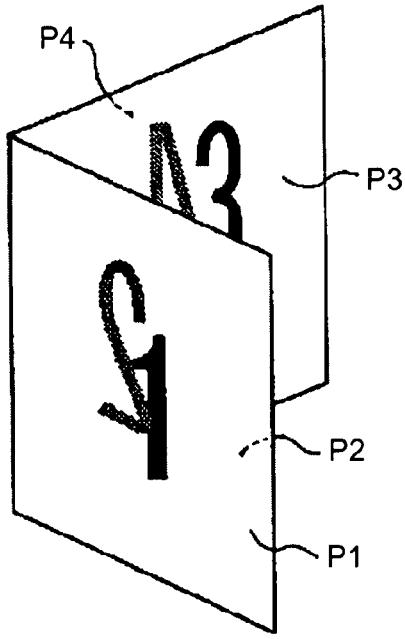
FIGS. 7A and 7B are schematic views of an image surface layout procedure for a center folding process.
Figure 7B:
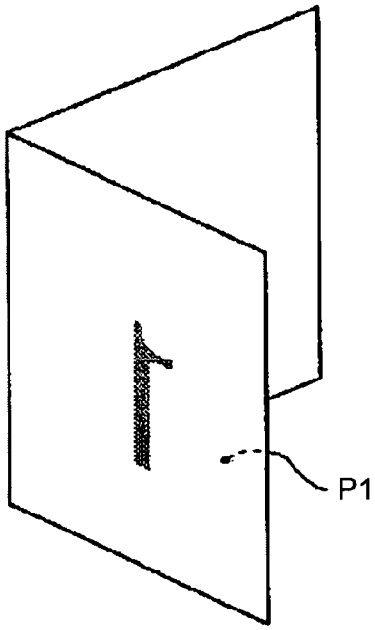

FIGS. 7A and 7B are schematic views of an image surface layout procedure for a center folding process. When a center folding process is performed, normally as shown in FIG. 7A, an image formation surface is laid out in a manner such that a first surface P1 comes outside with respect to center folding. In the present embodiment, however, since center folding is performed without reversing, the first surface P1 comes inside as shown in FIG. 7B. That is, for photographic printing, the image surface is laid out on a transparent portion side of the recording medium.

Figure 8:
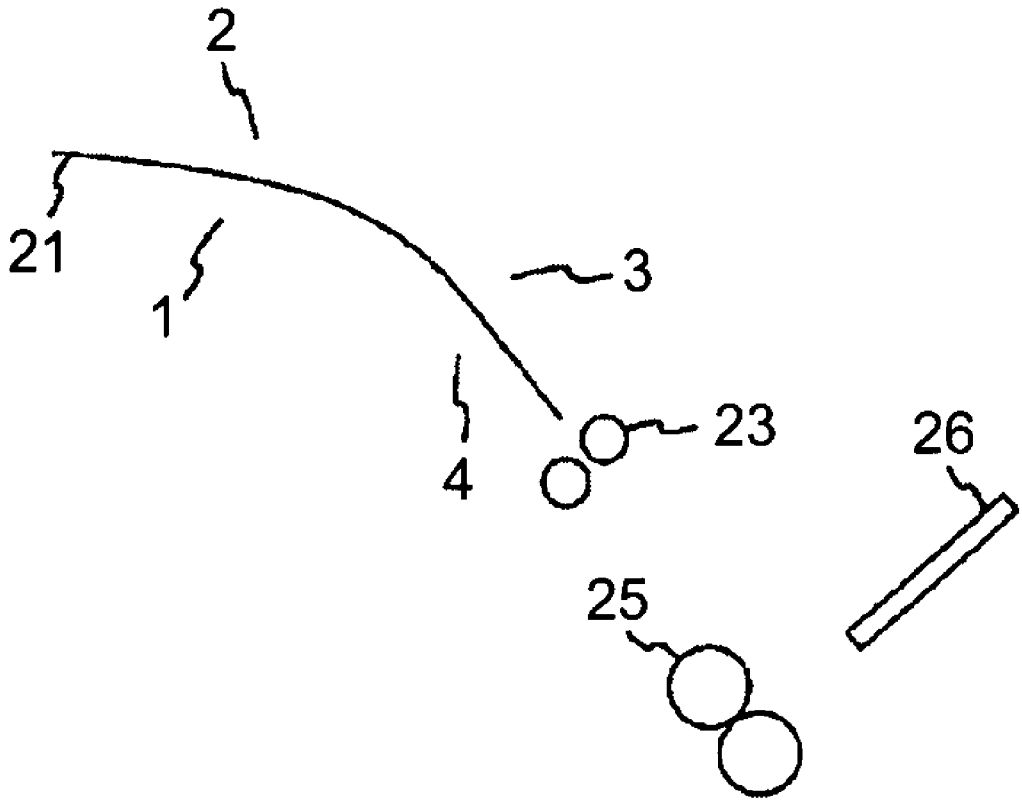
FIG. 8 is a schematic view of a surface of a recording medium before the start of a center folding operation in a general electrophotographic post-process.
Figure 9A:
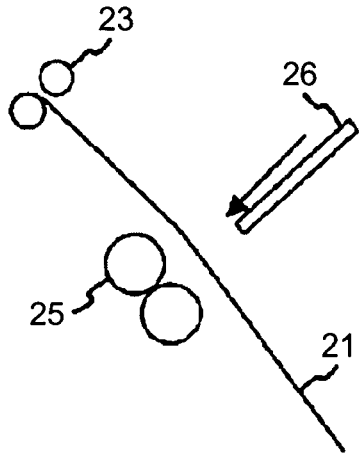
FIGS. 9A to 9C are schematic views of a flow of a center folding operation in a general electrophotographic post-process.
Figure 9B:
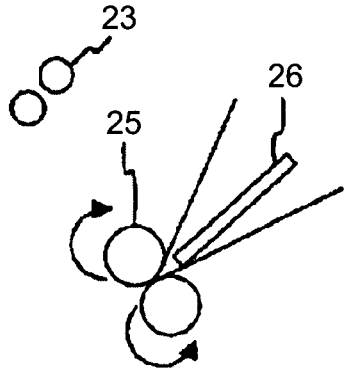
Figure 9C:
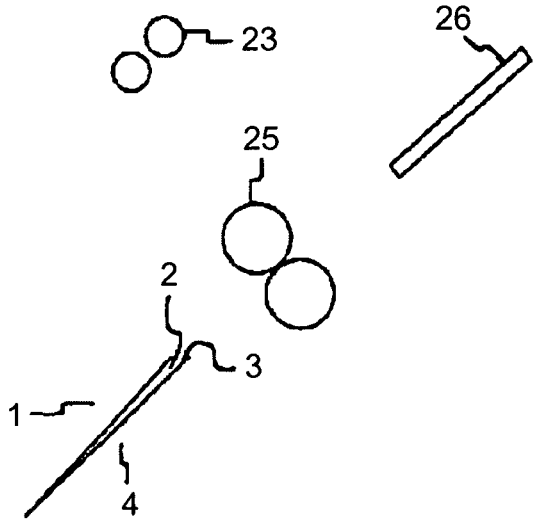

FIG. 8 is a schematic view of a surface of a recording medium before the start of a center folding operation in a general electrophotographic post-process. FIGS. 9A to 9C are schematic views of a flow of a center folding operation in a general electrophotographic post-process.

The recording medium 20 reversed and delivered so that the first surface comes outside is conveyed by the paired rollers 23 to the paired rollers 25 and a center folding plate 26, which are center folding units (FIG. 9A). The center portion of the recording medium 20 is pressed by the center folding plate 26 from outside (FIG. 9B) so that the recording medium 20 passes between folding rollers 25, thereby folding a single or plurality of medium sheets. After the center folding process, the image surface is laid out as shown in FIG. 7A.

Figure 10:
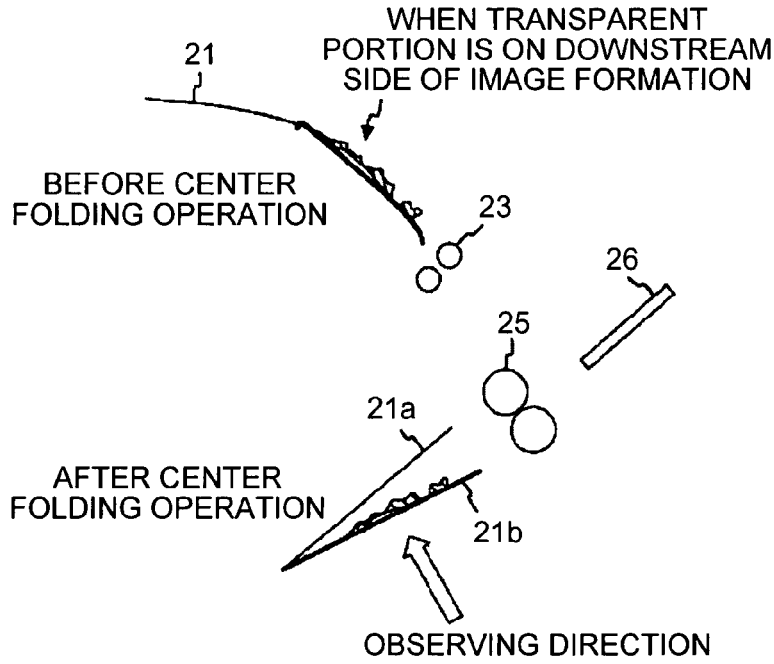
FIG. 10 is a schematic view of states before and after a center folding process according to the present invention when a transparent portion of a recording medium is located downstream with respect to a conveying direction.
Figure 11:
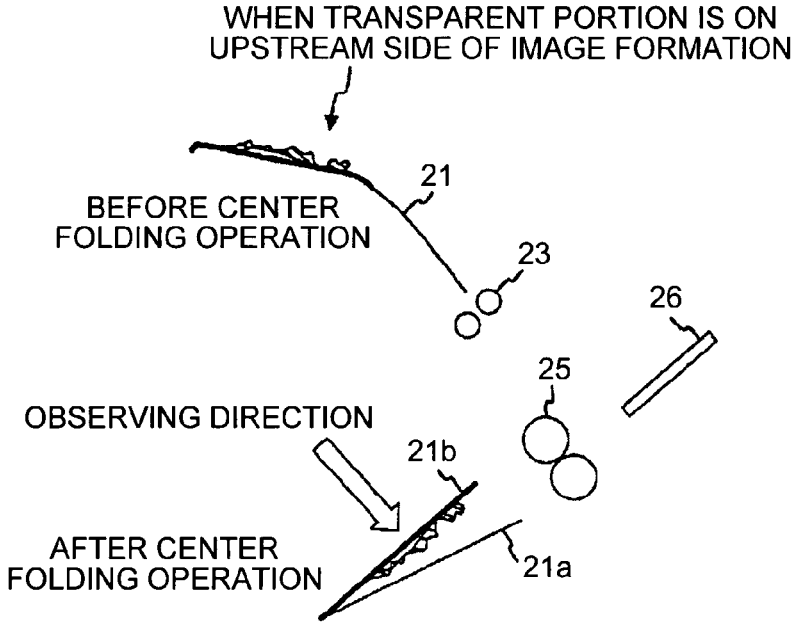
FIG. 11 is a schematic view of states before and after a center folding process according to the present invention when a transparent portion of a recording medium is located upstream with respect to a conveying direction.

FIG. 10 is a schematic view of states before and after a center folding process according to the present invention when the transparent portion of the recording medium is located downstream with respect to a conveying direction. FIG. 11 is a schematic view of states before and after a center folding process according to the present invention when the transparent portion of the recording medium is located upstream with respect to a conveying direction.

In the present embodiment, unlike a general use depicted as a comparison in FIGS. 8 and 9A to 9C, an image is formed inside the folding. Without reversing the transparent portion 20*b* of the recording medium 20 located downstream (FIG. 10) or upstream (FIG. 11) with respect to the conveying direction, the recording medium 20 is conveyed by the paired rollers 23 to the paired rollers 25 and the center folding plate 26. Next, the center portion of the recording medium 20 is pressed by the center folding plate 26 from outside to be passed between the folding rollers 25, thereby folding a single sheet of recording medium.

Since the transparent portion 20*b* is the image-provided surface of the recording medium 20, a photographic image with a uniform gloss can be viewed from the back of the recording medium. Also, the configuration is such that the image surface cannot be directly touched, and therefore excellent preservability can be achieved. Furthermore, since an opposite surface is non-transparent white, the color of the image is clear, and a more desirable image can be obtained.

A heat-sensitive adhesive layer formed on an image opposite surface of non-transparent white is explained below. The heat-sensitive adhesive contains a solid plasticizer and a thermoplastic resin emulsion as requisite components, these components being mixed with an adhesion providing agent. Such a mixture is applied on a supporting member to obtain a heat-sensitive adhesion material.

The surface of the adhesive layer of the heat-sensitive adhesion material does not have adhesiveness at all at room temperatures. However, by heating, adhesiveness becomes more apparent and, this adhesiveness maintains for a while even after a heat source is removed (an adhering state is maintained semipermanently). It is considered that the solid plasticizer is first melt by heating to the thermoplastic resin and the adhesion providing agent, thereby causing adhesiveness to become apparent.

The heat-sensitive adhesion material of this type is advantageous in view of resource saving and environmental protection because a releasing paper sheet is not used as in a general adhesion material. Furthermore, the heat-sensitive adhesion material can be attached only by being heated after abutting on an adherend, thereby preventing an adhesion error.

It was found that, as a compound for use as a solid plasticizer, in particular, at least one or more types of compounds having a benzoate group, a benzophenone group, a phenylenediamine group, and a benzothiazole group is used to further promote a low-temperature adhesive strength.

Specific examples include, but are not limited to: a compound 1 as a compound having a benzoate group; a compound 2, a compound 3, and a compound 4 as compounds having a benzophenone group, a compound 5 and a compound 6 as compounds having a phenylenediamine group; and a compound 7, a compound 8, a compound 9, a compound 10, and a compound 11 as compounds having a benzothiazole group.

In particular, the compound 1 having a benzoate group, the compound 2 having a benzophenone group, the compound 5 having a phenylenediamine group, and the compound 7 having a benzothiazole group have a high compatibility with thermoplastic resin or adhesion providing agent among others, and therefore have a high adhesiveness under a low-temperature environment.

Thermoplastic resin emulsions forming a heat-sensitive adhesive layer include, but are not necessarily limited to: (meta) acrylic ester copolymer, styrene-isoprene copolymer, styrene-acrylic ester copolymer, styrene-butadiene copolymer, acrylonitrile-butadiene copolymer, ethylene-vinyl acetate copolymer; vinyl acetate-acrylic ester copolymer, ethylene-vinyl chloride copolymer, ethylene-acrylic ester copolymer, vinyl acetate-ethylene-vinyl chloride copolymer, vinyl acetate-ethylene-acrylic ester copolymer, vinyl acetate-ethylene-styrene copolymer, polybutadiene, and polyurethane.

When an acrylic ester copolymer is used as a thermoplastic resin emulsion of a heat-sensitive adhesive layer, high adhesiveness can be achieved. Among others, it was found that 2-ethylhexyl acrylate is a resin that can increase an adhesive strength.

To the heat-sensitive adhesive layer, an adhesion providing agent can be added to increase an adhesive strength. Specific examples of the adhesion providing agent for use include terpene resin, aliphatic-series petroleum resin, aromatic-series petroleum resin, coumarone-indene resin, styrene-series resin, phenol resin, terpene phenol resin, and rosin derivative resin. These adhesion providing agents are used in a range of equal to or lower than 2.0 parts with respect to 1.0 part of the thermoplastic resin, preferably in a range of 0.2 to 1.5 parts. If the number of parts of the blocking inhibitor exceeds 2.0, blocking tends to occur.

By adding a blocking inhibitor to the heat-sensitive adhesive layer, blocking prevention in a high-temperature environment is further improved. Examples of the blocking inhibitor include waxes and inorganic fillers, which are listed below but are not restrictive.

Waxes include, for example, waxes such as animal wax, plant wax, and synthetic wax; higher fatty acids; higher fatty amides other than N-hydroxymethylstearic amid and stearic amid; higher fatty anilides; acetylatylides of aromatic amine; paraffin wax; Japan wax; carnauba wax; shellac; montan wax; paraffin oxide; polyethylene wax; and polyethylene oxide.

Higher fatty acids include, for example, sodium stearate and behenic acid. Higher fatty amides include, for example, stearate amid, oleic amid, N-methylstearic amid, eruci amid, methylol behenic amid, methylol stearic amid, methylene-bis-stearic amid, and ethylene-bis-stearic amid. Higher fatty anilides include, for example, stearic anilide and linoleic anilide. Acetylatylides of aromatic amine include, for example, acetotoluidide.

In addition, hot-melt materials other than waxes can include leuco dyes and developers for general use in photosensitive recording materials. These hot-melt materials including waxes desirably have a melting point as high as possible so as to minimize an influence on an adhesive strength.

Inorganic fillers include, for example, carbonates, oxides, hydroxides, and sulfates of aluminum, zinc, calcium, magnesium, barium, and titanium; and inorganic pigments containing clays, such as natural silica, zeolite, kaoline, and calcined kaoline. These inorganic fillers desirably have a oil absorbency as low as possible to minimize an influence on an adhesive strength.

These blocking inhibitors are used in a range of equal to or lower than 1.5 parts with respect to 1.0 part of the thermoplastic resin, preferably in a range of 0.6 to 1.0 part. If the number of parts of the blocking inhibitor exceeds 1.5, the adhesive strength tends to be decreased.

To the heat-sensitive adhesive layer, in order to increase adhesiveness between the heat-sensitive adhesive layer and the supporting member and coagulability in the heat-sensitive adhesive layer, a water-based high-polymer binder can be added, such as polyvinyl alcohol, polyvinyl acetate, starch oxide, etherified starch, cellulose derivatives such as carboxymethyl cellulose and hydroxyethyl cellulose, casein, gelatin, or alginic acid soda.

A mixing ratio of the water-based high-polymer binder is set so as not to impair an original adhesive strength of the heat-sensitive adhesive sheet. Specifically, the water-based high-polymer binder is used in a range equal to or lower than 30 weight percent with respect to all solids, more preferably, equal to or lower than 10 weight percent. To the heat-sensitive adhesive layer according to the present invention, other various additives can be added as required, such as a hardening agent, a preservative, a dye, a developer, a potential of hydrogen (pH) regulator, and an antifoaming agent.

The solid plasticizer and the thermoplastic resin of the heat-sensitive adhesive layer have melting points lower than a melting point of toner. Heating at a temperature between these melting points can achieve adhesion without melting the toner to disturb the image.

As has been discussed above, by implementing the present invention, as shown in FIG. 5, an image in which a print surface without asperities can be seen through a transparent portion of a recording medium can be obtained.

Therefore, a photographic image with excellent preservability conventionally requiring a complex configuration or a complex procedure can be easily obtained only by supplying a non-transparent portion and a transparent portion of a recording medium to the image forming apparatus. Also, according to the present embodiment, a center folding function can be used in a post-processing device can be used. Therefore, a photographic image can be automatically obtained.

Next, an image forming apparatus including a sheet-member attaching device according to another embodiment of the present invention is explained based on FIGS. 12 to 21D.

Figure 12:
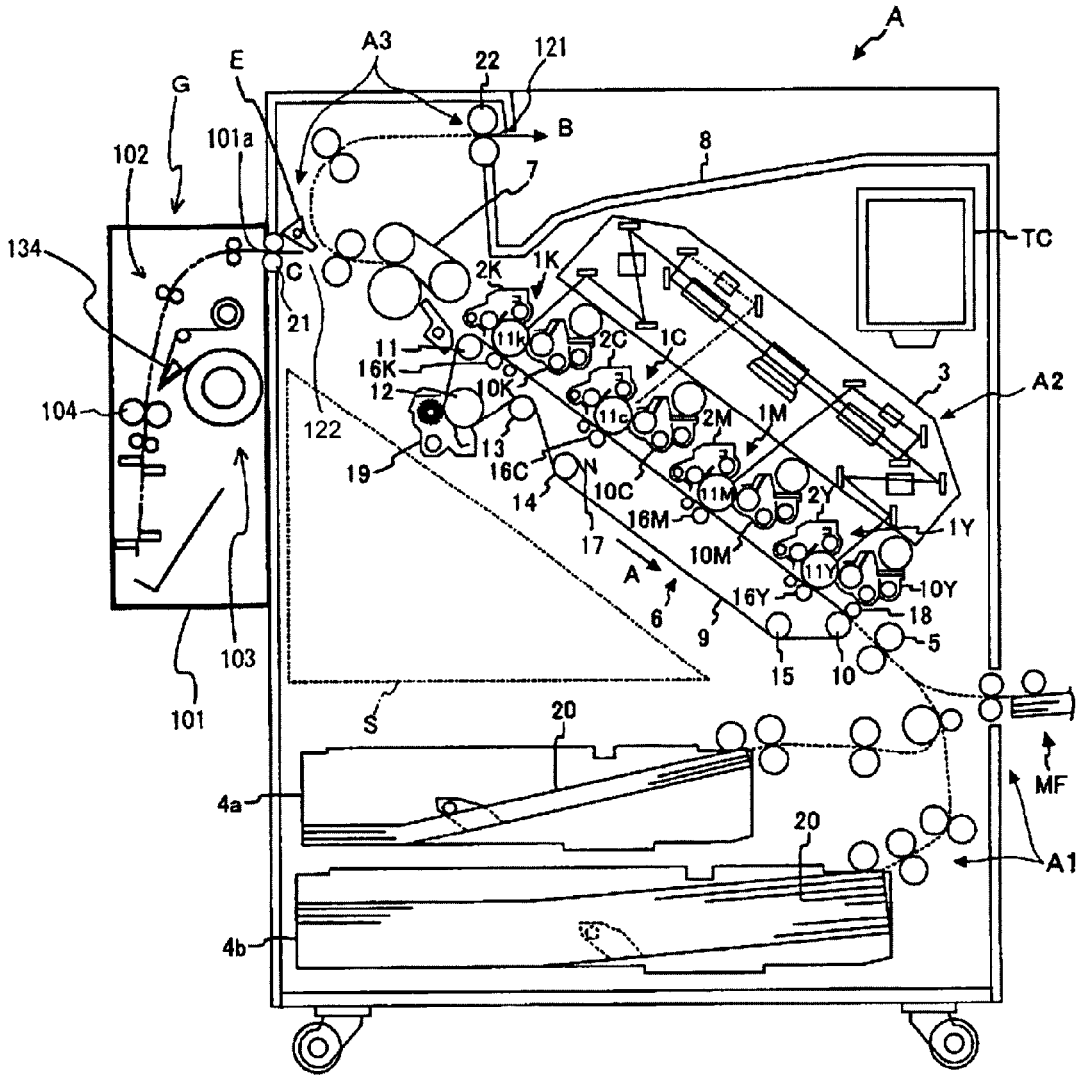
FIG. 12 is a schematic view of a state where the image forming apparatus is connected to a sheet-member attaching device according to the present embodiment.

A sheet-member attaching device G exemplarily shown in FIG. 12 is the one post-mounted on an electrophotographic image forming apparatus (full-color supported) A.

The image forming apparatus A has a configuration similar to that shown in FIG. 1, and therefore redundant explanation of each component is omitted herein.

Figure 13:
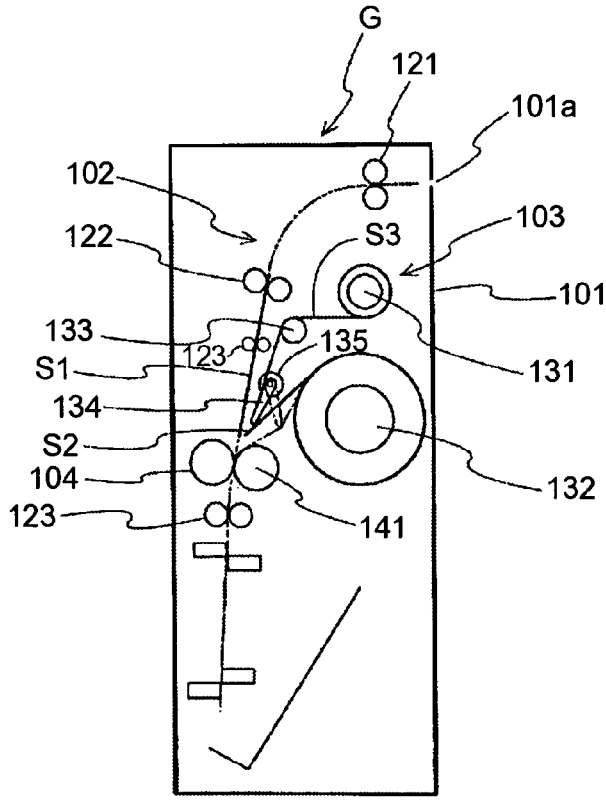
FIG. 13 is a schematic view before an operation of a separation plate of the sheet-member attaching device according to the present embodiment.

The sheet-member attaching device G includes, as shown in FIGS. 12 and 13, a box 101, a conveying unit 102, a letting-out unit 103, and paired crimping rollers 104 (a crimping unit). Here, an attaching unit includes the conveying unit 102 and the letting-out unit 103, whist a varying unit includes a separation plate 134 (which will be explained further below) as a component of the letting-out unit 103.

The box 101 is to form an outer shape of the sheet-member attaching device G, having formed inside therein each of the following functional units in a boxed shape, and is provided on one side surface of an upper portion of the box 101 with a recording-sheet receiving port 101*a* communicable with a sheet delivering unit 122 (of FIG. 12) for external device connection and an electrical connecting unit and a mechanical connecting unit (both are not shown), thereby being removably connected to the image forming apparatus A.

The conveying unit 102 includes first paired rollers 121 rotatably provided near the recording-sheet receiving port 101*a*, second paired rollers 122 rotatably provided lower left of the first paired rollers 121, third paired rollers 123 rotatable provided below the second paired rollers 122 so as to be slightly left of the second paired rollers 122, and a guide wall not shown. In this configuration, a transparent sheet S1 (mirror image P has been recorded thereon) delivered in an approximately horizontal direction from the sheet delivering unit 122 (of FIG. 12) for external device connection toward the recording-sheet receiving port 101*a* is conveyed downward as being bent. Also, in the conveying unit 102, rotation of the paired rollers 121 and other rollers can be controlled based on a control instruction from the control unit of the image forming apparatus A.

The letting-out unit 103 includes a rotation-controllable winding-up shaft 131 approximately straight below the arrangement position of the first paired rollers 121 and located at a predetermined position on a right side of the arrangement position of the second paired rollers 122, an original-sheet supporting shaft 132 rotatably provided approximately straight below the arrangement position of the winding-up shaft 131 and located at a predetermined position above the paired crimping rollers 104, which will be explained further below, an idle shaft 133 rotatably provided between the original-sheet supporting shaft 132 and the winding-up shaft 131 and located at a predetermined position of the winding-up shaft 131, and the separation plate 134 that is formed in a band-plate shape gradually tapered from one side edge in a longitudinal direction to an opposite side edge is diagonally provided so that the tapered side edge is oriented at a predetermined angle toward a sheet conveying route connecting the second paired rollers 122 and the third paired rollers 123.

Figure 14:
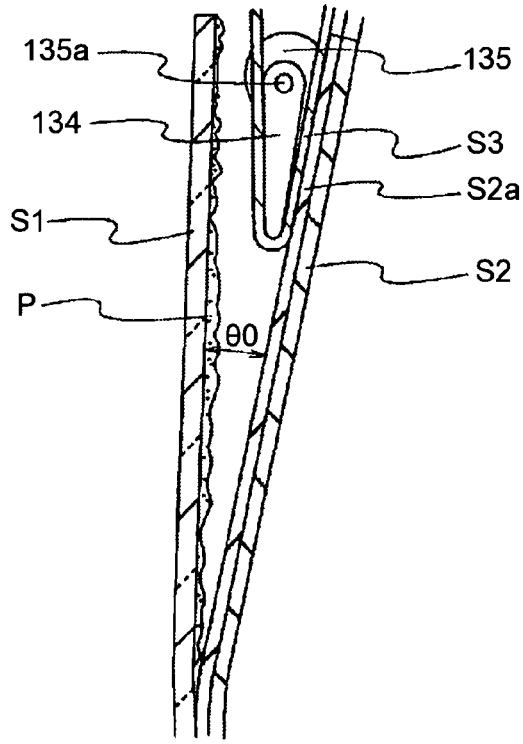
FIG. 14 is an enlarged view of surroundings of the separation plate in FIG. 13.
Figure 16:
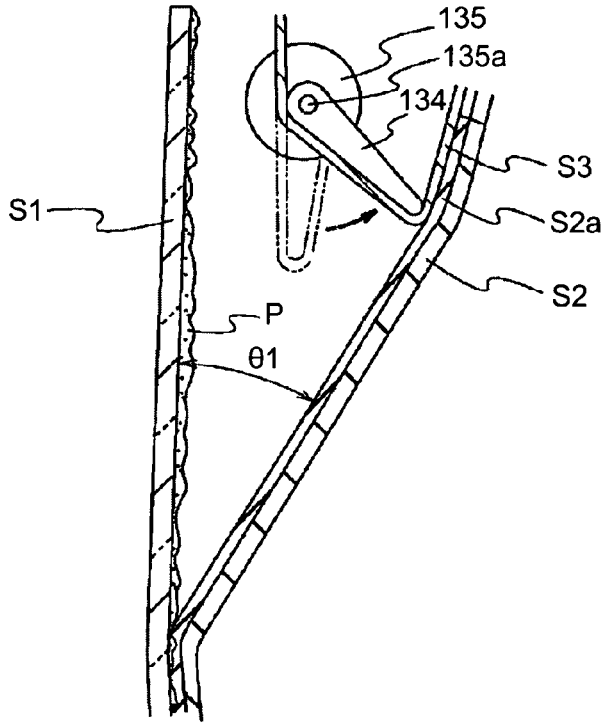
FIG. 16 is an enlarged view around the separation plate in FIG. 15.

Also, as shown in FIGS. 13 and 14, the separation plate 134 is formed to have a round tip of the tapered side edge so that a releasing paper sheet S3 can be smoothly folded and a non-transparent sheet S2 can be self-stripped from the releasing paper sheet S3. On the other hand, the opposite other side edge has a rotation shaft 135*a* of a rotary solenoid 135 fitting therein. As shown in FIG. 16, the separation plate 134 can swing by a predetermined angle with the rotation of the rotation shaft 135*a*.

The rotary solenoid 135 may be of a so-called ON/OFF type, but, preferably, is of a pulse-driven latching type (self-retaining type), in which a swinging speed and swinging angle can be easily controlled.

In the present embodiment, swings of the separation plate 134 using the rotary solenoid 135 is exemplified. However, this is not meant to be restrictive. For example, the configuration may be such that the other side edge mentioned above is pivoted at a fixing unit, such as a machine casing, and the separation plate 134 and the fixing unit, such as a machine casing, are connected via a linear solenoid to cause the separation plate 134 to swing with expansion and contraction of the linear solenoid.

Figure 17:
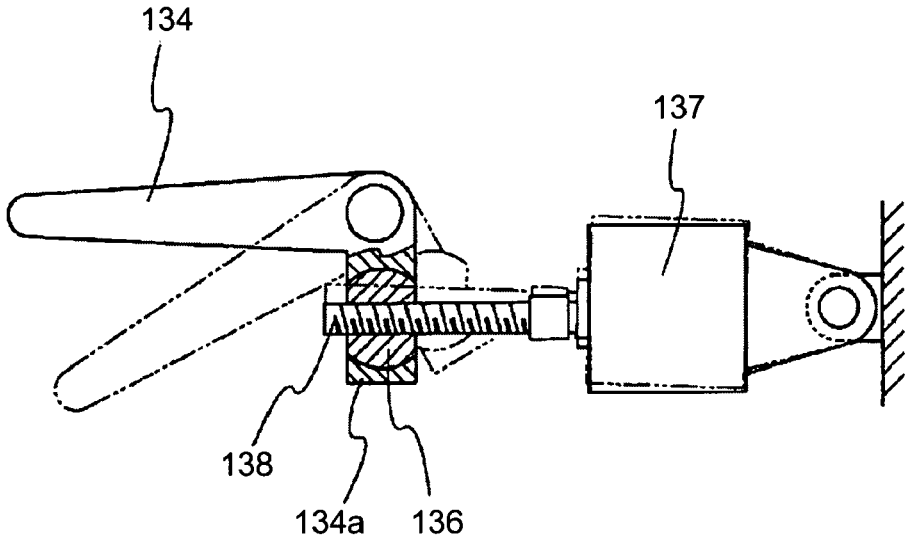
FIG. 17 is a schematic partially-sectioned side view another example of the surroundings of the separation plate.

Furthermore, as shown in FIG. 17, the configuration may be as follows. The other side edge mentioned above is pivoted at a fixing unit, such as a machine casing, and an approximately spherical nut 136 with a predetermined width and an outer appearance such that a sphere has two opposite ends both cut out loosely fits in an arm 134*a* extending from the side edge. The nut 136 has threadably mounted thereon a screw rod 138 driven by a motor 137. The rotation of the screw rod 138 causes the separation plate 134 to swing. Here, in this case, the nut 136 is locked for preventing rotation together with the rotation of the screw rod 138. Also, the base portion of the motor 137 is supported to the fixing unit, such as a machine casing, so as to be able to swing. In this manner, a driving unit that causes the separation plate 134 to swing is not particularly restricted.

Still further, the letting-out unit 103 uses an original sheet with a plurality of white non-transparent sheets S2 with predetermined length attached to the band-plate-shaped releasing paper sheet S3, the original sheet being wound with the non-transparent sheets S2 being inside. Here, on one side of the non-transparent sheet S2, an adhesion layer S2*a* onto which a transparent sheet S1 is to be attached. The adhesion layer S2*a* formed on one side of the non-transparent sheet S2 and a releasing layer formed on the releasing paper sheet S3 are attached together.

The state where the original sheet is set is explained. As shown in FIG. 13, the original sheet is set to the original-sheet supporting shaft 132 so that the sheet (formed of the releasing paper sheet S3 and the non-transparent sheet S2) is let out with the rotation in a counterclockwise direction. Of the drawn-out sheet, only the releasing paper sheet S3 is folded over by the separation plate 134. The folded-over releasing paper sheet S3 is further spread over the idle shaft 133 and is set around a winding-up shaft 31 so that the releasing paper sheet S3 is wound around the rotation in a counterclockwise direction.

In the letting-out unit 103 with the original sheet is set, the winding-up shaft 131 is rotated based on a control instruction from the control unit of the image forming apparatus A. Then, a part of the original sheet set around the original-sheet supporting shaft 132 is let out. Then, the sheet is folded over by the separation plate 134 and, at the same time, the non-transparent sheet S2 is released from the releasing paper sheet S3 and is diagonally let out toward a direction of conveying the transparent sheet S1 so as to be attachable to the transparent sheet S1 being conveyed by the conveying unit 102. In the present embodiment, the transparent sheet S1 and the non-transparent sheet S2 are conveyed by the conveying unit 102 and the letting-out unit 103 so as to be crossed each other. On the other hand, the releasing paper sheet S3 from which the non-transparent sheet S2 has been released is wound up by the winding-up shaft 131 for collection.

Here, the separation plate 134 is at an initial location (angle) so that an angle formed between the non-transparent sheet S2 and the transparent sheet S1 before contact is an angle at which the non-transparent sheet S2 and the transparent sheet S1 are reliably attached with a shock being suppressed when they are in contact with each other. Thereafter, the position can be varied at a predetermined timing.

The paired crimping rollers 104 are paired rollers rotatably provided at a predetermined position in the course of the sheet conveying route connecting the second paired rollers 122 and the third paired rollers 123, the predetermined position being slightly downstream of a position where the transparent sheet S1 and the non-transparent sheet S2 cross each other in a conveying direction. The paired crimping rollers 104 receives the attached transparent sheet S1 and non-transparent sheet S2 for further pressing, thereby strongly attaching these sheets together.

The sheet-member attaching device G according to a first embodiment of the present invention as configured above is removably connected to the image forming apparatus A to perform a series of the following operations.

First, by using an operation panel or the like of the image forming apparatus A, an output mode using the sheet-member attaching device G is selected for starting the formation a mirror image P onto the transparent sheet S1. At this time, an original image for image formation is a captured image from a scanner device provided at the top of the image forming apparatus A or an electronic image transmitted from an electronic device, such as a personal computer or a digital camera. Here, supplying the transparent sheet S1 to the image forming apparatus A is not particularly restrictive. The transparent sheet S1 can be supplied from a sheet tray provided in the device or can be supplied through so-called manual feeding.

Then, through a known electrophotographic process, a toner image (mirror image) formed with a small-particle-diameter polymerized toner is transferred and fixed onto the transparent sheet S1, and is then delivered out from the sheet-delivering unit 122 for external device connection. At this time, the transparent sheet S1 passing through the fixing unit 7 in the image forming apparatus A toward the sheet-delivering unit 122 for external device connection has its image surface with the recorded mirror image P oriented downward. The downward-oriented transparent sheet S1 passes the sheet-delivering unit 122 for external device connection and then enters the sheet-member attaching device G from the recording-sheet receiving port 101*a*.

The conveying unit 102 that has received the transparent sheet S1 conveys the transparent sheet S1 downward. At this time, the winding-up shaft 131 is rotated at a predetermined timing based on a control instruction from the control unit of the image forming apparatus A, thereby causing a part of the original sheet set around the original-sheet supporting shaft 132 to be let out, causing the non-transparent sheet S2 to be released from the releasing paper sheet S3 by the separation plate 134 and to be diagonally let out so that the non-transparent sheet S2 is superposed on the transparent sheet S1 being conveyed. Here, the conveying speed of the transparent sheet S1 and the conveying speed of the non-transparent sheet S2 are equal to each other.

The transparent sheet S2 started to be conveyed is attached and affixed to the tip of the transparent sheet S1, as shown in FIGS. 13 and 14, at a predetermined attachment angle θ0 determined by the layout of the conveying unit 102 and the letting-out unit 103 and the initial position of the separation plate 134. In this manner, a shock at the time of first crossing the transparent sheet S1 and the non-transparent sheet S2 is suppressed to ensure a reliably start of attachment.

Figure 15:
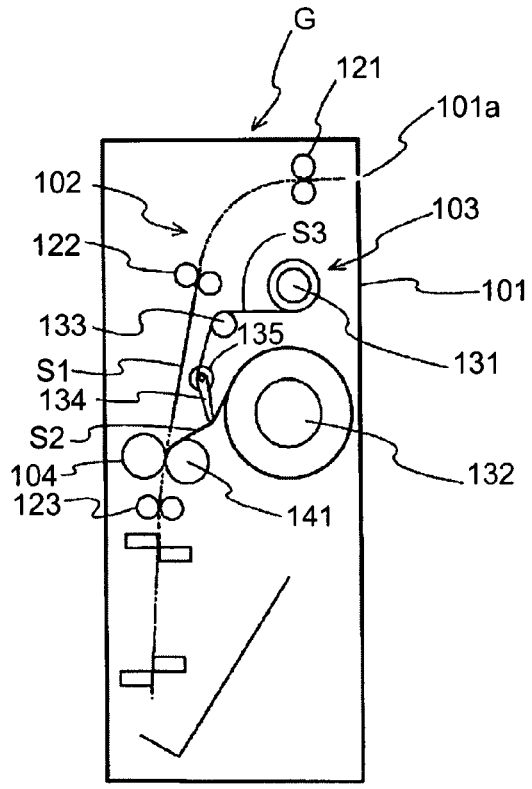
FIG. 15 is a schematic view after the operation of the separation plate of the sheet-material attaching device according to the present embodiment.

Immediately after the start of attachment or after attachment over a predetermined length from the start of attachment, the rotary solenoid 135 is activated with a control signal from the control unit. As shown in FIGS. 15 and 16, the separation plate 134 then swings in a counterclockwise direction to spread the sheet (the releasing paper sheet S3 and the non-transparent sheet S2). The non-transparent sheet S2 is then let out at an angle based on the angle formed by spreading. With this, the transparent sheet S1 and the non-transparent sheet S2 are attached together at an attachment angle θ1. In this manner, with the attachment angle θ1 being larger than the initial attachment angle θ0, air bubbles are prevented from entering.

Also, the timing of changing the attachment angle θ0 to the attachment angle θ1 may be when the tip of the attached sheets reaches the paired crimping rollers. The timing is not particularly restricted to this case, and may be taken through temporal control by a time count or the like, or may be taken by using a sensor to detect a collision state between the tip of the transparent sheet S1 and the tip of the non-transparent sheet S2 or whether the tip of the attached sheets has reached the paired crimping rollers and use the detection result.

In this manner, the transparent sheet S1 and the non-transparent sheet S2 are attached together until the rear ends of both sheets are superposed each other. In this procedure, the paired crimping rollers 104 strongly attaches both sheets immediately after their initial attachment.

Then, when the rear end of the transparent sheet S1 and the rear end of the non-transparent sheet S2 pass through the third paired rollers 123 to complete attachment of both sheets, the separation plate 134 moves back to the initial position, the rotation of the winding-up shaft 131 stops, and the resulting sheet is delivered to an internal sheet delivering unit provided at a lower portion inside the box 101 as an image recording sheet. When the delivery is completed, the conveying unit 102 stops the conveying operation, and waits until the start of the next attaching operation. With this, a series of operations of the sheet-member attaching device G according to the first embodiment is completed.

Here, the speed of changing from the attachment angle θ0 to the attachment angle θ1 is set at a predetermined speed at which the sheet (the releasing paper sheet and the non-transparent sheet S2) can be smoothly let out. Alternatively, the speed can be gradually varied from the attachment angle θ0 mentioned to the attachment angle θ1 and eventually become the attachment angle θ1 at or immediately before the end of attachment.

Figure 18:
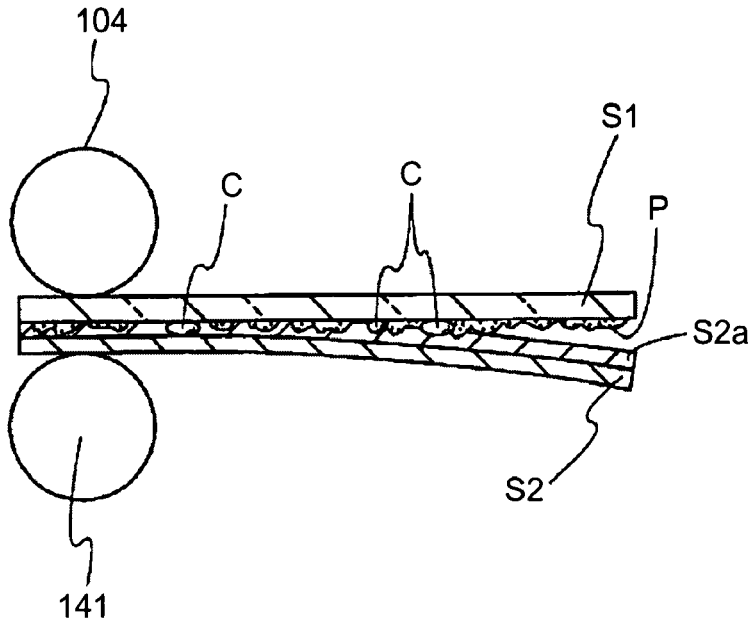
FIG. 18 is a longitudinal cross-section view of a state where air bubbles are being taken in a space between a transparent sheet and a non-transparent sheet.
Figure 19:
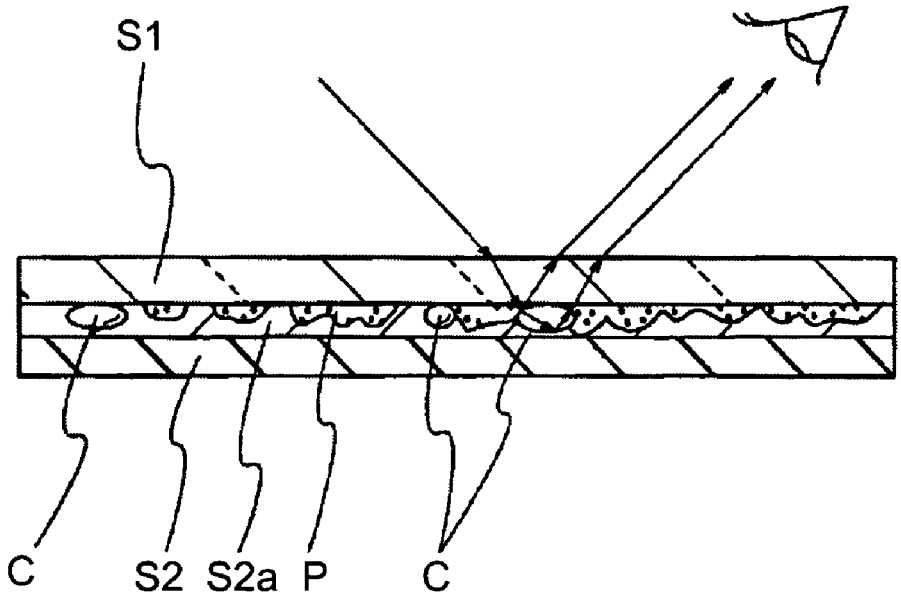
FIG. 19 is a longitudinal cross-section view of a state where air bubbles have been taken in the space between the transparent sheet and the non-transparent sheet.

As for the relation between entrance of air bubbles and the attachment angle, consider the case of an attachment angle on the order of 10 degrees to 45 degrees, for example. In this case, when both sheets makes contact with each other, although attachment with a suppressed shock can be ensured, air bubbles tend to enter due to asperities on the surface of the adhesion layer S2*a*, subtle fluctuations of the sheets, and other factors, as shown in FIG. 18. If even subtle air bubbles are taken in, as shown in FIG. 19, diffused reflection occurs at a portion where the air bubbles have been taken in, which is very inconvenient as an image recording sheet.

Conversely, in the case of an attachment angle over 30 degrees and within 90 degrees, for example, although attachment with a suppressed shock is extremely difficult to achieve, it was found that intake of the air bubbles C is extremely decreased if the sheets have been attached already. In the present embodiment, the attachment angle is changed from the attachment angle θ0 to the attachment angle θ1 through the operation of the separation angle 134, and therefore the sheets can be reliably attached without the occurrence of air bubbles.

Then, when the rear end of the transparent sheet S1 and the rear end of the non-transparent sheet S2 pass through the third paired rollers 123 to complete attachment of both sheets, the resulting sheet is delivered to the internal sheet delivering unit provided at a lower portion inside the box 101 as an image recording sheet. Then, the conveying unit 102 stops the conveying operation, and waits until the start of the next attaching operation. With this, the series of operations of the sheet-member attaching device G according to the present embodiment is completed.

Figure 20:
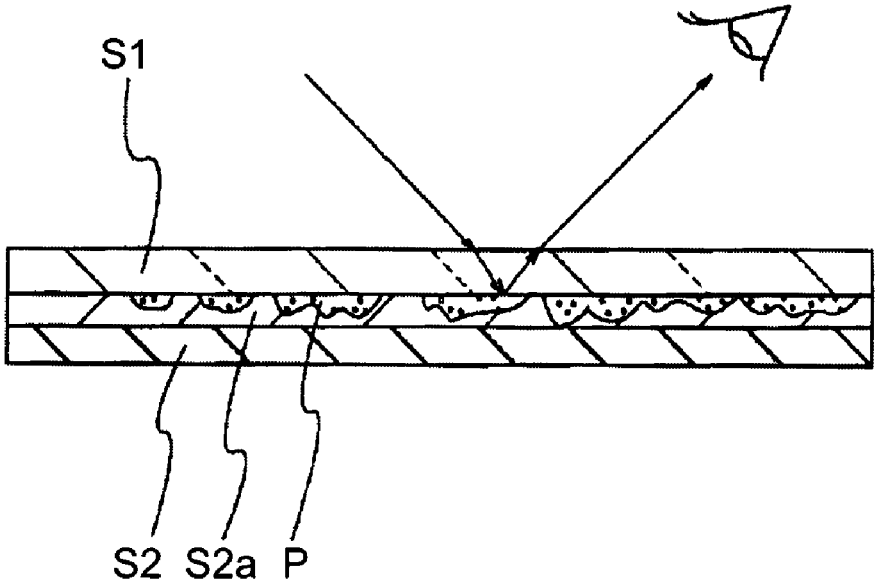
FIG. 20 is a longitudinal cross-section view of a state where the transparent sheet and the non-transparent sheet have been attached to each other.

In this manner, the sheet-member attaching device G according to the present embodiment attaches the transparent sheet S1 and the non-transparent sheet S2 together so as to interpose the mirror image P by increasing, with the actuation of the separation plate 134, the attachment angle between the transparent sheet S1 formed with the mirror image P and the non-transparent sheet S2 from the attachment angle θ0 to the attachment angle θ1. In this manner, as shown in FIG. 20, a photographic image recording sheet with a normal image in external appearance can be obtained. In particular, the toner image is formed with a small-particle-diameter polymerized toner, thereby reducing a step height depending on areas of the toner image, reducing the possibility of occurrence of air bubbles between the transparent sheet S1 and the non-transparent sheet S2, increasing the texture of the image itself, and obtaining higher image quality.

Figure 21A:
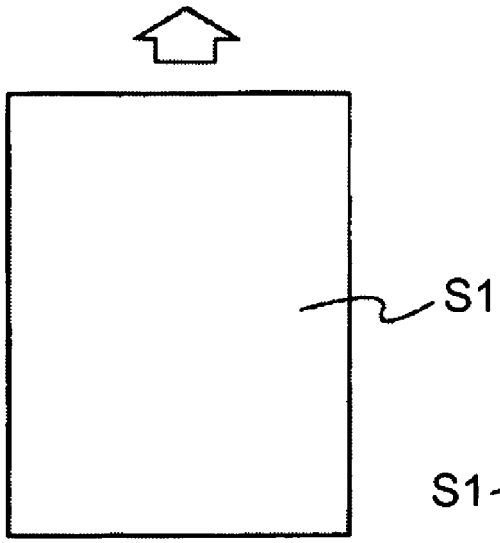
FIGS. 21A to 21D are plan views of exemplary variations of the transparent sheet.
Figure 21B:
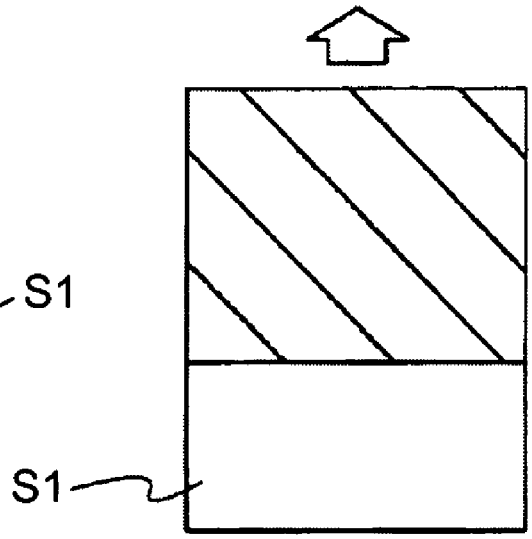
Figure 21C:
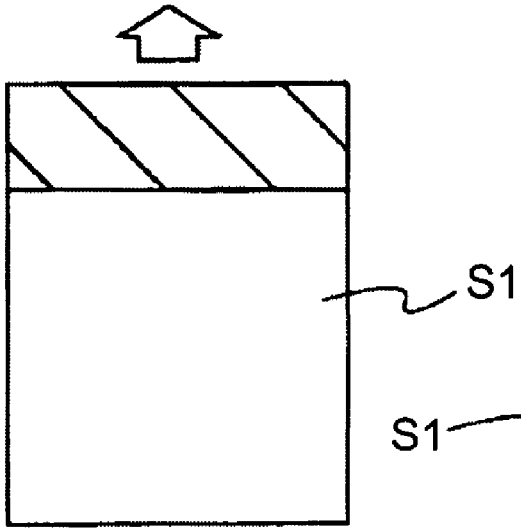
Figure 21D:
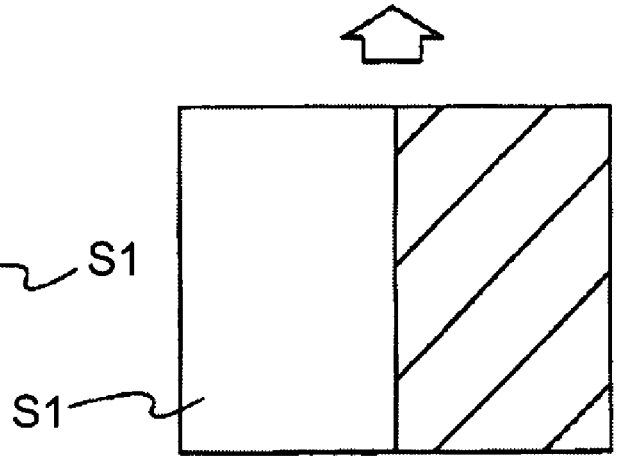

Here, the transparent sheet S1 exemplified in the present embodiment is transparent all over the entire area of the sheet, as shown in FIG. 21A. Alternatively, as shown in FIGS. 21B to 21D, the transparent sheet S1 may a transparent sheet that is partially non-transparent (for example, white). Here, in FIGS. 21B to 21D, areas shaded with diagonal lines in parallel represent non-transparent areas, whilst other areas represent transparent areas.

While the sheet-member attaching device G according to the present invention has been explained above, the embodiment explained above represents merely an exemplary embodiment of the present invention. The present invention is not restricted to this embodiment, and can be variously modified and implemented within a scope not deviating from the gist of the invention.

For example, in the present embodiment, when the attachment angle is changed, the separation plate 134 is activated. This is not meant to be restrictive. Alternatively, an operation-controllable guide plate may be used that can press the first sheet member or the second sheet member so as to bend the sheet member to change the conveying direction. In this case, the specific configuration of the guide plate is preferably identical to the configuration of the separation plate 134 due to its simplicity.

Still alternatively, in place of such an attachment-angle varying unit as the guide plate or the separation plate 134, the arrangement position of the conveying unit or the letting-out unit may be varied by shifting. In this case, it is preferable that these conveying unit and letting-out unit be configured as a unit and this unit itself be activated.

Also, the exemplary case has been discussed in the present embodiment in which the mirror image P is formed on the transparent sheet S1 and the white non-transparent sheet S2, for example, and the transparent sheet S1 are then attached together. Alternatively, the image P may be formed on the non-transparent sheet S2 and that non-transparent sheet S2 and the transparent sheet S1 may be then attached together.

In the present embodiment, the sheet-member attaching device G in conjunction with the image forming apparatus A has been exemplified. The present invention can be applied not only to devices that output an image recording sheet, but also to devices as long as the devices attach sheets together.

Furthermore, although the sheet-member attaching device G has been exemplified in the present embodiment, a sheet-member attaching method may be used in which a conveying direction(s) of either one or both of the first sheet member and the second sheet member is (are) varied to change the attachment angle for attachment. Also, in this case, the attachment angles θ0 and θ1 and the varying timing exemplified in the embodiment explained above are suitable.

In addition, a method may be used in which the first sheet member and the second sheet member are attached together so as to interpose the image P therebetween to obtain an image recording sheet. As exemplified in the embodiment explained above, it is preferable that the mirror image P be formed on the transparent sheet S1 by using a small-particle-diameter polymerized toner and the white non-transparent sheet S2, for example, and the transparent sheet S1 be attached together.

According to the present invention, the first sheet member and the second sheet member are conveyed so as to cross each other, and the first sheet member and the second sheet member cross at their crossing position so as to be attachable together. Also, the sheet-member conveying direction is varied to change the attachment angle (for example, the attachment angle is increased as appropriate at the time of attachment), thereby optimizing the attachment angle at the time of the start of attachment and the attachment angle during attachment. With this, a shock when the first sheet member and the second sheet member cross is suppressed, and attachment can be achieved with entrance of air bubble being preventable.

In particular, in the case of an image recording sheet formed by interposing an image formed by an electrophotographic image forming apparatus (it is extremely suitable to form an image by using a small-particle-diameter polymerized toner) between a transparent sheet and a non-transparent sheet, such as a white paper sheet, for attachment, extremely high image quality close to photographic quality can be obtained without entrance of air bubbles.

Figure 22:
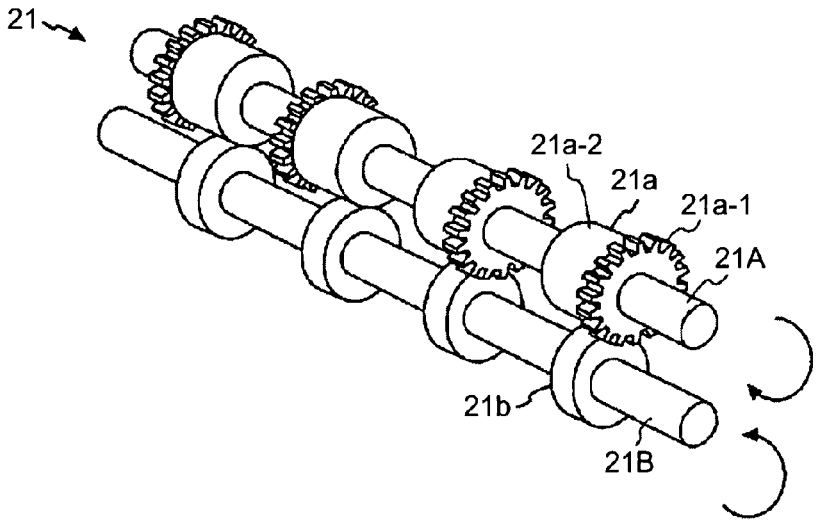
FIG. 22 is a perspective view before and after releasing strength-providing rollers, with a space between paired sheet-delivery rollers being widened, at the time of forming an image other than a photographic image.
Figure 23:
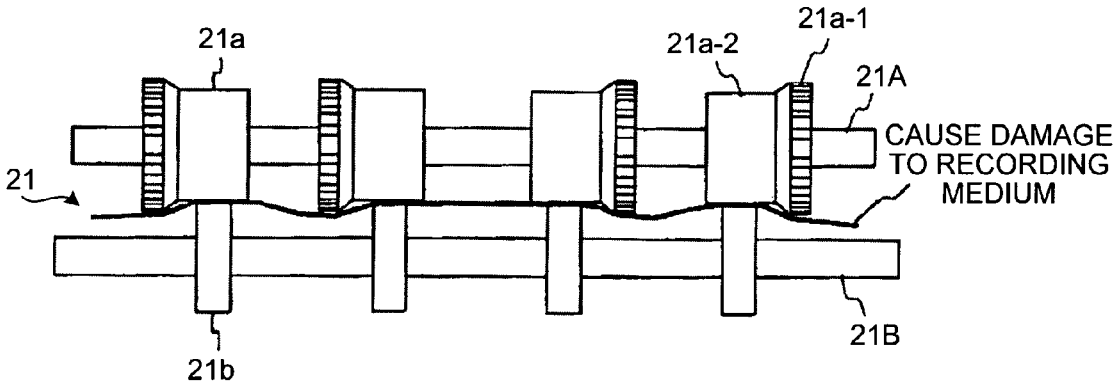
FIG. 23 is a front view of the paired sheet-delivery rollers of FIG. 22.
Figure 24:
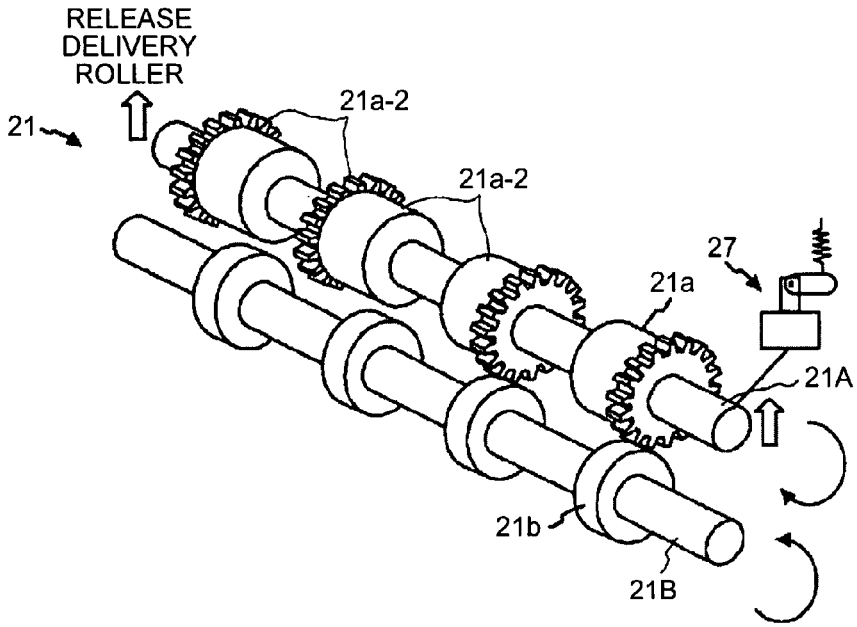
FIG. 24 is a perspective view of a state where the strength-providing rollers are released, with the space between the paired sheet-delivery rollers being widened, at the time of forming an image with photographic quality.
Figure 25:
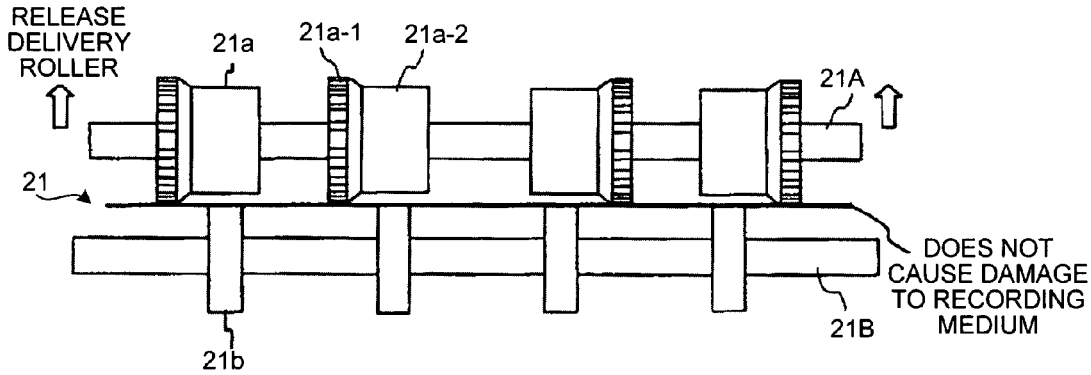
FIG. 25 is a front view of the paired sheet-delivery rollers of FIG. 24.

FIG. 22 is a perspective view of a state of the paired sheet-delivery rollers at the time of forming an image other than a photographic image. FIG. 23 is a front view of the paired sheet-delivery rollers of FIG. 22. FIG. 24 is a perspective view of a state where the space between the paired sheet-delivery rollers is increased at the time of forming an image with photographic quality. FIG. 25 is a front view of the paired sheet-delivery rollers of FIG. 24.

The paired sheet-delivery rollers (paired sheet-delivery members) 21 that deliver the sheet subject to image formation to the post-processing device F or G include a plurality of strength-providing rollers (sheet-delivery members) 21*a* and a plurality of the sheet-delivery rollers (sheet-delivery members) 21*b*. Each strength-providing roller 21*a* is disposed with each predetermined space in a state where an axial center of these rollers is supported by a shaft 21A. Each sheet-delivery roller 21*b* is disposed with each predetermined space in a state where an axial center of these rollers is supported by a shaft 21B. Each strength-providing roller 21*a* is formed of an uneven roller portion (capstan roller portion) 21*a*-1 having a large diameter with asperities in a gear shape around an outer circumference and a flat roller portion 21*a*-2 having a small diameter without asperities. Each sheet-delivery roller 21*b* has a flat configuration without asperities, and is arranged so as to have a positional relation corresponding to a relevant one of the flat roller portions 21*a*-2 of the strength-providing rollers 21*a*.

As a material for forming a surface layer of each of the rollers 21*a* and 21*b*, resin, such as polyacetal (POM), or rubber can be used.

As shown in FIGS. 22 and 23, when a normal paper sheet with a low strength having formed thereon an image other than an image with photographic quality is delivered, for example, the strength-providing rollers 21*a* are made contact with or made closer to the sheet-delivery rollers 21*b*, thereby applying pressure onto the normal paper sheet between the rollers to deform the normal paper sheet in a sufficient wavy shape. With this, the paper sheet can be delivered through a stable path without a sag. On the other hand, if a sheet having formed thereon an image with photographic quality is delivered with the both types of rollers are close to each other in this manner, the pressure of the strength-providing rollers 21*a* is not released, and therefore the recording medium 20 is damaged. In particular, this will significantly degrade photographic quality (texture) because the uneven roller portions (asperities) 21*a*-1 leave sliding marks on the image surface. When a photographic image is formed on an OHP sheet, the sheet is softened due to residual heat immediately after fixing and tends to be damaged. Therefore, scars due to the asperities of the strength-providing roller portions tend to be left not only on the image surface but also on a non-image surface.

To get around this problem, in the present invention, as shown in FIGS. 24 and 25, in the case of forming an image with photographic quality, either one of the types of rollers is spaced apart from another one by a predetermined distance, thereby releasing (reducing) the pressure from the strength-providing rollers 21*a* onto the recording medium 20 to prevent damages on the recording medium 20.

A mechanism that releases the pressure, that is, widens a space between the sheet-delivery rollers 21*b* and the strength-providing rollers 21*a* (a pressure reducing mechanism or a mechanism for widening a space between the paired sheet-delivery rollers) is configured such that, as schematically shown in FIG. 24, the shaft 21A supporting the paired strength-providing rollers 21*a* is moved back and forth by a solenoid 27 or the like, thereby moving the strength-providing rollers 21*a* toward or away from the sheet-delivery rollers 21*b*. That is, either one of the rollers 21*a* and 21*b* forming either one type of the sheet-delivery rollers 21 is configured so as to be movable toward or away from the other one of the rollers. With this, the distance between the rollers can be freely adjusted, thereby making it possible to adjust a pressure on the recording medium.

When an image obtained by reversing an original image is formed on the recording medium 20 at least a part of which is transparent, the pressure onto the recording medium 20 from the sheet-delivery rollers 21 immediately after fixing is reduced, thereby preventing an uneven roller mark on the recording medium 20 having the transparent portion 20*b*.

With this, it is possible to improve a texture of the surface with photographic quality obtained by superposing the non-transparent portion 20*a* or another non-transparent recording medium on the transparent portion 20*b*. Also, not only reducing the pressure of the sheet-deliver rollers, the strength-providing rollers 21*a* for supporting thin sheets are released, thereby not only improving the texture of the surface of the image but also preventing a wavy portion.

As explained above, the OHP sheet when delivered from the fixing unit is softened due to heat and is in a state where a roller mark tends to be left. Therefore, a roller mark also tends to be left on a non-image formation surface side of the transparent portion 20*b* of the recording medium. Such a roller mark can significantly degrade the quality of the photographic image.

On the other hand, the OHP sheet (having a thickness on the order of 0.2 millimeters) originally has a strength, and therefore no strength-providing units (sheet-delivery rollers) for normal paper sheets are required.

As in the present embodiment, for the sheet-delivery rollers 21, it is preferable that one type of rollers be formed as the strength-providing rollers 21*a* formed of capstan rollers each having the uneven roller portion 21*a*-1 on its outer circumference, whilst the other be formed as the sheet-delivery rollers 21*b* without asperities. In particular, the strength-providing rollers 21*a* formed of capstan rollers are disposed on a lower portion and the sheet-delivery rollers 21*b* without asperities are disposed on an upper portion. With this, a sheet-delivering effect can be expected in which the rear edge of the recording medium is reliably pushed (kicked) by the uneven roller portions (asperities) 21*a*-1 of the strength-providing rollers 21*a*. Also, the strength-providing rollers 21*a* disposed on a lower portion are taken as a driving side and the sheet-delivery rollers 21*b* without asperities disposed on an upper portion are taken as a driven side. With this, conveyance with a minimum pressure onto the recording medium 20 can be achieved, thereby preventing formation of a scar on the recording medium.

Figure 26:
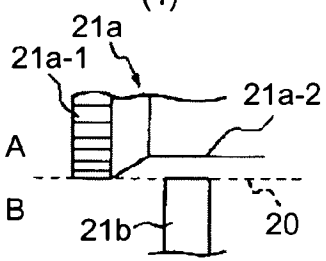
FIG. 26 is a table that depicts degrees of conveyance for comparison among a case where a vertical positional relation between the strength-providing rollers having asperities and the sheet-delivery rollers is changed, a case where a space between these rollers is changed, and a case where rollers to be driven are changed.
Figure 26:
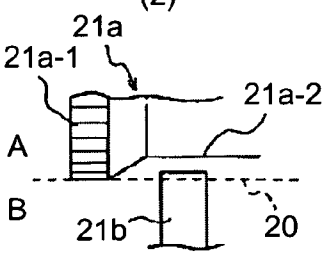
Figure 26:
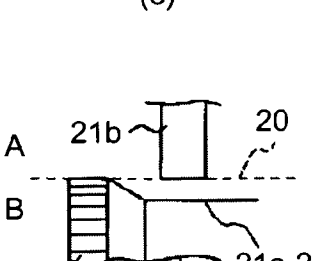
Figure 26:
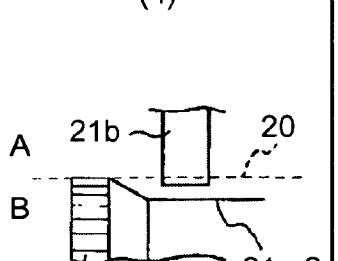

FIG. 26 is a table that depicts the results of an experiment by the Applicant, in which degrees of conveyance are depicted for comparison among a case where a vertical positional relation between the strength-providing rollers having asperities and the sheet-delivery rollers is changed, a case where a space between these rollers is changed, and a case where rollers to be driven are changed.

In a first case shown in FIG. 26, when the strength-providing rollers 21*a* are disposed on the upper side, the space between the rollers 21*a* and 21*b* is set widely so that the recording medium 20 passing between the strength-providing rollers 21*a* and the sheet-delivery rollers 21*b* disposed on the lower side is in an approximately linear state (in a non-wavy state). When the strength-providing rollers 21*a* on the upper side are taken as a driving side, the strength-providing rollers 21*a* tend to rotate at idle even if the recording medium 20 is slightly sagged, thereby making conveyance extremely difficult (represented by a cross mark). On the other hand, when the sheet-delivery rollers 21*b* positioned on the lower side are taken as a driving side, conveyance is better compared with the case where the strength-providing rollers are taken as a driving side, but stability is not achieved (represented by a triangle mark).

Next, in a second case shown in FIG. 26, the strength-providing rollers 21*a* are disposed on the upper side, and the space between the rollers are narrowed so that a strength is provided to form a wavy shape on the recording medium 20. Therefore, the outer circumference of the sheet-delivery rollers 21*b* enter upward of the outer circumference of the uneven roller portions 21*a*-1. In this case, when the strength-providing rollers 21*a* are taken as a driving side, conveyance is not impossible, but not so excellent (represented by a triangle mark). On the other hand, when the sheet-delivery rollers 21*b* positioned on the lower side are taken as a driving side, excellent conveyance can be achieved (represented by a circle mark).

In a third case shown in FIG. 26, the strength-providing rollers 21*a* are disposed on the lower side, and the space between the rollers 21*a* and 21*b* is set widely so that the recording medium 20 is in an approximately linear state (in a non-wavy state). When the sheet-delivery rollers 21*b* are taken as a driving side, the sheet-delivery rollers 21*b* tend to rotate at idle even if the recording medium 20 is slightly sagged, thereby making conveyance extremely difficult (represented by a cross mark). On the other hand, when the strength-providing rollers 21*a* positioned on the lower side are taken as a driving side, conveyance is better compared with the case where the sheet-delivery rollers 21*b* are taken as a driving side, but stability is not achieved (represented by a triangle mark).

In a fourth case shown in FIG. 26, the sheet-delivery rollers 21*b* are disposed on the upper side, and the space between the rollers 21*a* and 21*b* are narrowed so that a strength is provided to form a wavy shape on the recording medium 20. When the sheet-delivery rollers 21*b* positioned on the upper side are taken as a driving side, conveyance is not impossible, but not so excellent (represented by a triangle mark). On the other hand, when the strength-providing rollers 21*a* positioned on the lower side are taken as a driving side, excellent conveyance can be achieved (represented by a circle mark).

As in the first and second cases shown in FIG. 26, when the strength-providing rollers 21*a* on the upper side are formed of capstan rollers with the uneven roller portions 21*a*-1 and the sheet-delivery rollers 21*b* on the lower side are formed of rollers without asperities, an optimum positional relation between the sheet-delivery rollers (space therebetween or pressure onto the recording medium) is varied depending on which type of the rollers 21*a* or 21*b* is taken as a driving side.

That is, when the strength-providing rollers 21*a* on the upper side are taken as a driving side, for excellent delivery of the OHP sheet, conveyance (sheet delivery) cannot be ensured unless the space between the rollers is set narrow so that a sheet-feeding pressure (P1) to the recording medium is sufficiently strong.

On the other hand, when the strength-providing rollers 21*a* on the upper side are taken as a driven side, the space between the rollers is set wide so that a sheet-feeding pressure (P2) is weaker than the sheet-feeding pressure (P1). With this, the OHP sheet can be conveyed to some extent, but stability cannot be achieved.

Next, as in the third and fourth cases shown in FIG. 26, also when the sheet-delivery rollers 21*b* are on the upper side and the strength-providing rollers 21*a* are on the lower side, an optimum positional relation between the sheet-delivery rollers (space therebetween or pressure onto the recording medium) is varied depending on which type of the rollers 21*a* or 21*b* is taken as a driving side.

That is, when the strength-providing rollers 21*a* positioned on the lower side are taken as driving rollers, for excellent delivery of the OHP sheet, the space between the rollers 21*a* and 21*b* is set maximum, thereby minimizing a sheet-feeding pressure (P3). In this case, an effect can be expected in which the rear edge of the recording medium is engageably stopped with the asperities of the strength-providing rollers 21*a* positioned on the lower side, thereby reliably pressing the recording medium in a sheet-delivering direction. Therefore, the space between the delivery rollers can be maximized. Thus, by appropriately setting the space between the rollers, a roller mark that may be formed on the surface of the recording medium can be minimized.

On the other hand, when the sheet-delivery rollers 21*b* on the upper side are taken as a driving side and the strength-providing rollers 21*a* on the lower side are taken as a driven side, the space between the rollers 21*a* and 21*b* has to be narrowed more compared with the case where the lower side is taken as a driving side so as to maximize a sheet-feeding pressure (P4). In this case, stable sheet delivery cannot be achieved unless the sheet-feeding pressure (P4) is maximized. In this case, the surface of the recording medium is pressed and slid onto the stopping asperities. Therefore, a roller mark tend to be formed most strongly on the surface of the recording medium.

Thus, the sheet-feeding pressures in the cases shown in FIG. 26 have a relation of $$P4>P1>P2>P3.$$

Next, other issues found from the experiment results shown in FIG. 26 are as follows.

(a) Conveyance is more increased when the rollers disposed on the lower portion are taken as a driving side irrespectively of the presence or absence of uneven roller portions.

(b) When the strength-providing rollers 21*a* having the uneven roller portions are disposed on the lower side, a sheet-delivery effect can be expected in which the rear edge of the recording medium sagging downward by gravity can be kicked out. Therefore, conveyance can be improved.

(c) When the rollers disposed on the upper side are taken as a driving side irrespectively of the presence or absence of uneven roller portions, the circumferential surfaces of the rollers on the upper side slide over the surface of the recording medium. As a result, a sliding mark tends to be left on the surface of the recording medium. That is, when the rollers on the upper side are driven, these rollers slide over the surface of the recording medium to possibly cause a mark to be left. However, even if the rollers on the lower side are driven, a sliding mark produced by strongly sliding over the surface of the recording medium can be prevented. Therefore, driving the rollers on the lower side irrespectively of the presence or absence of uneven roller portions is preferable in view of preventing damages on the recording medium.

Next, a measure is explained below for mitigating or eliminating damages from the rollers onto the surface of the recording medium 20 at least a part of which has the transparent portion 20*b* (OHP portion), aside from the consideration mentioned above for ensuring conveyance.

The transparent portion 20*b* of the recording medium 20 immediately after delivered from the fixing unit 7 has one surface with an image being formed. After delivery from the image forming apparatus, the non-transparent portion 20*a* or the non-transparent sheet S2 is attached onto the image formation surface of the transparent portion 20*b* by the center folding device F or the sheet-member attaching device G. For this reason, such a roller mark as being formed by shallowly scraping the image portion of the transparent portion 20*b* with the roller may often be unrecognizable from the front surface.

On the other hand, the front surface side (non-image formation surface) of the transparent portion 20*b* is in a state where the surface tends to be damaged by heat for fixing. Therefore, a roller mark (in particular, a mark due to the asperities of the strength-providing rollers) tends to be formed.

To improved conveyance, as explained above, the space between the rollers has to be narrowed to increase the sheet-feeding pressure on the recording medium. By increasing the sheet-feeding pressure, however, a roller mark tends to be formed on the surface of the recording medium. To get around this, it is preferable that the sheet-feeding pressure be set so as not to damage the image formed on the transparent portion 20*b* or the front surface side (non-image surface). Specifically, the sheet-feeding pressure is set slightly lower than a minimum sheet-feeding pressure that can ensure sufficient conveyance, thereby preventing damages onto the surface of the recording medium.

The timing of providing and releasing a sheet-feeding pressure from both types of rollers onto the recording medium 20 to be delivered by the sheet-delivery rollers 21 is varied depending on the configuration of the recording medium 20 (an area ratio between the transparent portion and the non-transparent portion or a positional relation). That is, when the sheet-feeding pressure of the paired sheet-delivery rollers 21 is set higher at the time of selecting and entering by an operator an OHP sheet as a sheet for use, the sheet-feeding pressure has to be returned to the one for normal paper sheets when image formation is halted immediately before its start. For this reason, the sheet-feeding pressure is set high after the image forming operation has started.

When the entire surface of the recording medium 20 is configured of a transparent portion formed of an OHP sheet, the control unit returns the sheet-feeding pressure to the one for normal paper sheets after delivery of all recording media associated with a series of jobs has been completed. Whether sheet delivery has been completed may be detected by a filler dedicated for sheet delivery, a photosensor, or the like, or may be determined based on a detection timing by another sheet-passing sensor provided near an outlet of the fixing unit and, if no next job is present, the sheet-feeding pressure is returned to the original.

When a photographic image is formed on the transparent portion 20*b* of the recording medium 20 having the non-transparent portion 20*a*, the pressure may be applied or released at the same timing as that when the entire surface is formed of an OHP sheet. Alternatively, a sheet-feeding pressure may be applied at a timing when the tip of the transparent portion 20*b* enters a nip portion (a portion where the rollers face each other) of the paired sheet-delivery rollers 21, and the sheet-feeding pressure may be released at a timing of releasing the transparent portion.

In this manner, the pressure by the paired sheet-delivery rollers is decreased immediately before the transparent portion enters the nip portion, the pressure is decreased at a timing when the non-transparent portion (non-photographic image portion) enters the nip portion while the space between the rollers is widened, or the space between the rollers is narrowed. With this, degradation in conveyance is prevented.

Figure 27A:
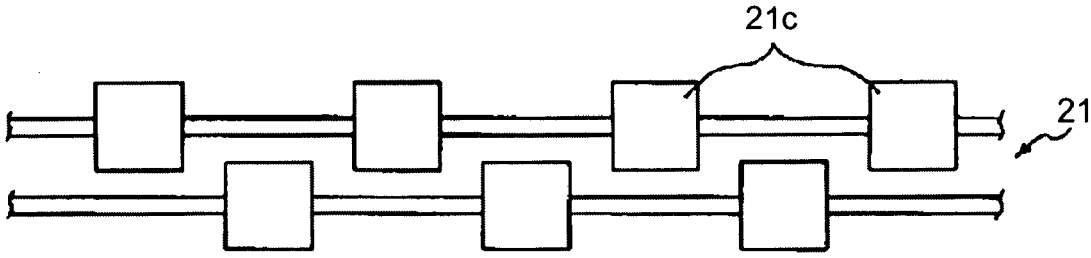
FIGS. 27A and 27B are drawings for explaining configurations of paired conveyor members according to other embodiments of the present invention.

Alternatively, as shown in FIG. 27A, sheet-delivery rollers (sheet-delivery members) 21*c* forming the paired sheet-delivery rollers 21 may be rollers without asperities.

Figure 27B:
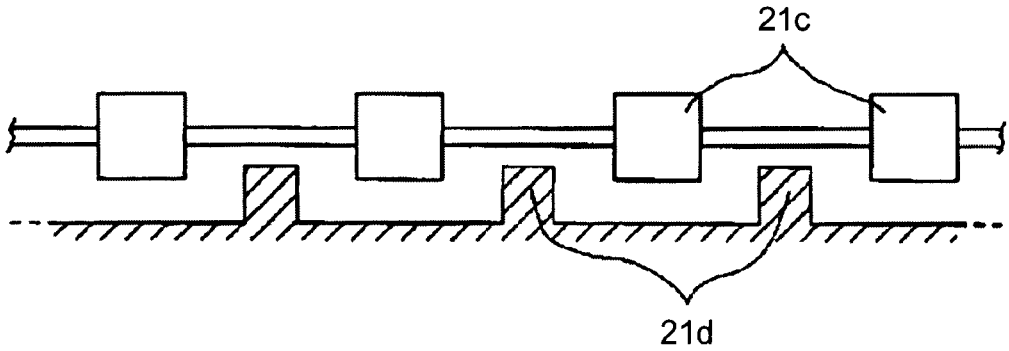

Still alternatively, as shown in FIG. 27B, the sheet-delivery rollers 21 of one type may be the rollers 21*c*, whilst those of the other type may be protruding sheet-delivery members (fixed guides) 21*d*.

According to the present invention, when an image obtained by reversing an original image is formed on a recording medium at least a part of which has a transparent portion, a pressure from the sheet-delivery rollers to a recording medium immediately after fixing is reduced, thereby preventing an uneven roller mark on the transparent portion. With this, it is possible to improve a texture of the surface with photographic quality obtained by superposing a non-transparent portion of the recording medium or another non-transparent recording medium.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a sheet feeding unit configured to feed a recording media, the recording media including non-transparent, transparent and partially transparent recording media;

an image forming unit configured to form a reverse image on a transparent region of the transparent or partially transparent recording media;

a sheet-delivery unit configured to convey the recording media from the image forming unit, the sheet-delivery unit including first and second sheet-delivery members forming a pair, the first and second sheet-delivery members having lengthwise axial centers shifted with respect to each other, at least one of the first and second sheet-delivery members configured to be movable; and a control unit configured to control the sheet-delivery unit, including controlling a sheet-feeding pressure that is a pressure exerted on the recording media by the first and second sheet-delivery members, such that a first sheet-feeding pressure exerted on the transparent region having the reverse image is less than a second sheet-feeding pressure exerted on the non-transparent media, wherein the control unit is configured to set the sheet-feeding pressure to the first sheet-feeding pressure immediately before a leading edge of the transparent region enters a first nip portion of the first and second sheet-delivery member pair, and increase the sheet-feeding pressure to the second sheet-feeding pressure immediately after a trailing edge of the transparent region leaves a second nip portion of the first and second sheet-delivery member pair.

2. The image forming apparatus according to claim 1, wherein the first sheet-delivery member is a capstan roller with an outer circumference having a corrugated portion, the first sheet-delivery member being below the second sheet-delivery member and a driving side of the pair.

3. The image forming apparatus according to claim 1, wherein the image forming unit is one of an electrophotographic image forming unit and an inkjet printing unit.

4. The image forming apparatus according to claim 1, wherein the control unit is configured to set the sheet-feeding pressure to a default sheet-feeding pressure after a job is completed, the default sheet-feeding pressure being about the second sheet-feeding pressure.

5. The image forming apparatus according to claim 1, wherein the recording media is the partially transparent media.

6. The image forming apparatus according to claim 1, wherein the control unit is configured to control a timing of increasing and decreasing the sheet-feeding pressure based on at least one of an area ratio between the transparent region and a non-transparent region and a positional relationship between the transparent region and the non-transparent region.

7. The image forming apparatus according to claim 1, wherein the control unit is configured to change the sheet-feeding pressure to slightly lower than a minimum sheet feeding pressure that can ensure sufficient conveyance of the non-transparent media while conveying the transparent media.

* * * * *